US010128063B2

(12) United States Patent
Liao et al.

(10) Patent No.: US 10,128,063 B2
(45) **Date of Patent: *Nov. 13, 2018**

(54) KEYSWITCH

(71) Applicants: DARFON ELECTRONICS (SUZHOU) CO., LTD., Suzhou, Jiangsu Province (CN); DARFON ELECTRONICS CORP., Taoyuan (TW)

(72) Inventors: Rui-Ming Liao, Taoyuan (TW); Chih-Chung Yen, Taoyuan (TW); Hung-Chieh Lo, Taoyuan (TW); Chia-Hung Liu, Taoyuan (TW)

(73) Assignees: DARFON ELECTRONICS (SUZHOU) CO., LTD., Suzhou, Jiangsu Province (CN); DARFON ELECTRONICS CORP., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,035

(22) Filed: Jan. 14, 2018

(65) Prior Publication Data

US 2018/0137994 A1 May 17, 2018

Related U.S. Application Data

(63) Continuation of application No. 15/422,443, filed on Feb. 1, 2017, now Pat. No. 10,068,726.

(30) Foreign Application Priority Data

Feb. 3, 2016 (TW) ..... 105103637 A
Sep. 7, 2016 (TW) ..... 105128929 A

(51) Int. Cl.
*H01H 13/14* (2006.01)
*H01H 13/02* (2006.01)
(Continued)

(52) U.S. Cl.
CPC ..... *H01H 13/14* (2013.01); *H01H 13/023* (2013.01); *H01H 13/10* (2013.01);
(Continued)

(58) Field of Classification Search
CPC .... H01H 13/14; H01H 3/125; H01H 13/7065; H01H 2221/044; H01H 2221/036;
(Continued)

(56) References Cited

U.S. PATENT DOCUMENTS 4,831,223 A * 5/1989 Wako ..... H01H 13/20 200/290
5,886,603 A * 3/1999 Powell ..... H01H 9/16 200/318

(Continued)

*Primary Examiner* — Ahmed Saeed
(74) *Attorney, Agent, or Firm* — Winston Hsu

(57) ABSTRACT

A keyswitch uses a combination of springs connected in serial for providing a return force to a keycap of the keyswitch. When the keycap moves toward a base of the keyswitch beyond a transition position, one of the springs stops continuously deforming. It leads to an increment of the elastic coefficient of the combination of springs and an increment of the elastic stored energy by the combination of springs. Therefore, during a pressing on the keycap, the keycap can provide a light force feedback and then a heavy force feedback to a user. Further, the keyswitch can use a switch with a lateral motion, which can reduce influence of a resilient force produced by the switch on the up and down movement of the keycap. The keyswitch also can use an elastic piece disposed beside the keycap, which can provide a tactile feedback to the user.

21 Claims, 24 Drawing Sheets

(51) Int. Cl.

| | |
|---|---|
| ***H01H 13/10*** | (2006.01) |
| ***H01H 13/28*** | (2006.01) |
| ***H01H 13/52*** | (2006.01) |
| *H01H 1/24* | (2006.01) |
| *H01H 3/42* | (2006.01) |

(52) U.S. Cl.
CPC ..... *H01H 13/28* (2013.01); *H01H 13/52* (2013.01); *H01H 1/24* (2013.01); *H01H 3/42* (2013.01); *H01H 2201/018* (2013.01); *H01H 2205/004* (2013.01); *H01H 2215/00* (2013.01); *H01H 2215/028* (2013.01); *H01H 2215/03* (2013.01)

(58) Field of Classification Search
CPC ..... H01H 13/48; H01H 13/52; H01H 13/56; H01H 13/20; H01H 13/36; H01H 13/365; H01H 15/02; H01H 15/06; H01H 1/242; H01H 13/12
USPC ..... 200/11 J, 16 C, 61.74, 450, 453, 458, 200/459, 276, 290, 325, 5 A, 314, 200/341–345
See application file for complete search history.

(56) References Cited

U.S. PATENT DOCUMENTS

| | | | | |
|---|---|---|---|---|
| 6,326,570 | B1 * | 12/2001 | Fujii | H01H 1/36 200/341 |
| 6,753,489 | B2 * | 6/2004 | Kiyono | H01H 13/183 200/200 |
| 10,068,726 | B2 * | 9/2018 | Liao | H01H 13/023 |
| 2011/0147186 | A1 * | 6/2011 | Mori | H01H 5/06 200/468 |

* cited by examiner

KEYSWITCH

CROSS REFERENCE TO RELATED APPLICATIONS

This application is a continuation application of and claims the priority benefit of U.S. patent application Ser. No. 15/422,443, filed on Feb. 1, 2017, now pending. The entirety of the above-mentioned patent application is hereby incorporated by reference herein and made a part of this specification.

BACKGROUND OF THE INVENTION

1. Field of the Invention

The invention relates to a keyswitch, and especially relates to a keyswitch using a spring for producing return force.

2. Description of the Prior Art

Keyswitches on the market commonly use a spring or a rubber dome for producing a required return for the keycap thereof. In general, the used spring has a single fixed spring constant. If the spring constant is small, the return force produced by the spring is small and a resistant force to a user pressing the keycap is also small, so that the user can press down the keycap quickly. However, because the return force is small, the time for the pressed keycap to return its original position is long, which is inconvenient for the user to press the keycap successively in a short time. If the spring constant is large, the return force produced by the spring is large and the pressed keycap can return its original position in a short time. However, because the return force is large, the resistant force to a user pressing the keycap is large, so that the user needs to press the keycap by a larger force, which brings a fatigue to the fingers of the user so that it is inconvenient for the user to press the keycap successively in a short time. Furthermore, the deformation mechanism of the rubber dome is different from the linear deformation of the spring. The deformation property of the rubber dome cannot be shown in a fixed spring constant. In general, at the beginning of the elastic deformation of the rubber dome, the rubber dome still can remain its geometric structure and provides a relatively large spring constant. When the structure of the rubber dome begins to buckle, the rubber dome provides a relatively small spring constant. Although the spring constant is relatively large at the beginning of the elastic deformation, the deformation amount is relatively small; although the spring constant is relatively small at the following buckling deformation, the deformation amount is relatively large. Therefore, in use, the user can sense a large threshold of pressing force, but the pressing force by the user after the threshold is small; furthermore, the whole elastic energy stored by the deformed rubber dome is not high. On the whole, compared with the keyswitch using the spring with a high spring constant, the keycap of the keyswitch using the rubber dome still takes a relative long time to return to its original position. Therefore, the current keyswitches (no matter using a spring or a rubber dome) cannot provide their keycaps an action of being pressed down quickly and returning quickly which can reduce the degree of fatigue of the fingers of the user when the user manipulates the keyswitch in some environments such as of electronic sports.

SUMMARY OF THE INVENTION

An objective of the invention is to provide a keyswitch. The keyswitch uses a combination of springs connected in series to provide a force feedback which is light first and then heavy, so that a user can easily press the keycap of the keyswitch quickly and the keycap can return quickly after the pressing is released.

A keyswitch of an embodiment according to the invention includes a keycap, a base, and a combination of springs. The base is disposed under the keycap and includes a boss extending toward the keycap. The combination of springs is disposed between the keycap and the base. The combination of springs includes a first spring and a second spring connected with the first spring in series, so that when the keycap receives a pressing force to move from an initial position toward the base, the keycap transfers the pressing force to the combination of springs, and the pressing force is then transferred to the base through the first spring and the second spring in order. An outer diameter of the boss is less than a coil inner diameter of the second spring. The outer diameter of the boss is larger than a coil inner diameter of the first spring. The second spring is sleeved on the boss and includes a plurality of elastic coils. Therein, when the keycap moves from the initial position toward the base beyond a transition position, the second spring is fully compressed to be solid such that a height of said spring reaches a corresponding solid height, a lower end of the first spring abuts against the boss, the first spring is not fully compressed and remains elastically deformable as the keycap moves toward the base further, and the plurality of elastic coils substantially stack vertically.

A keyswitch of another embodiment according to the invention includes a keycap, a base, a combination of springs, and a switch. The keycap includes a triggering portion. The base is disposed under the keycap. The combination of springs is disposed between the keycap and the base. The combination of springs includes a first spring and a second spring connected with the first spring in series, so that when the keycap receives a pressing force to move from an initial position toward the base, the keycap transfers the pressing force to the combination of springs, and the pressing force is then transferred to the base through the first spring and the second spring in order. The switch is fixed on the base and includes a fixed contacting part and a movable contacting part disposed neighboring to the fixed contacting part. The movable contacting part is a cantilever structure. The cantilever structure has a fixed end, a free end, and a contacting portion. The cantilever structure is fixed on the base through the fixed end. The contacting portion is located between the fixed end and the free end and is used for electrically contacting the fixed contacting part. Therein, when the keycap moves from the initial position toward the base beyond a transition position, one of the first spring and the second spring is fully compressed to be solid such that a height of the compressed spring reaches a corresponding solid height, and the other one of the first spring and the second spring is not fully compressed and remains elastically deformable as the keycap moves toward the base further, the compressed spring whose height reaches the corresponding solid height comprises a plurality of elastic coils, and the plurality of elastic coils substantially stack vertically. When the keycap is at the initial position, the triggering portion pushes against the movable contacting part through the free end to make the movable contacting part separated from the fixed contacting part. When the keycap moves toward the base beyond a triggering position, the triggering portion and the movable contacting part are separate so that the movable contacting part moves to contact the fixed contacting part through the contacting portion.

Therefore, for the above keyswitches, before the keycap reaches the transition position, each of the first spring and the second spring contributes to the elastic deformation, so the spring constant of the combination of springs is relatively small. The user can easily press down the keycap quickly. The force feedback is also relatively small. After the keycap moves downward beyond the transition position, one of the first and second springs is compressed to the corresponding solid height so that said spring cannot provide further elastic deformation. Only the other one of the first and second springs can continue contributing to the elastic deformation. Therefore, the spring constant of the combination of springs increases and the keycap can obtain a relatively large return force, so that when the user no longer presses the keycap, the keycap can return to its original position quickly. Thereby, the keycap can move up and down quickly. The user can sense a light first and then heavy pressing feeling, which reduces the degree of fatigue of the user when the user manipulates the keyswitch.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
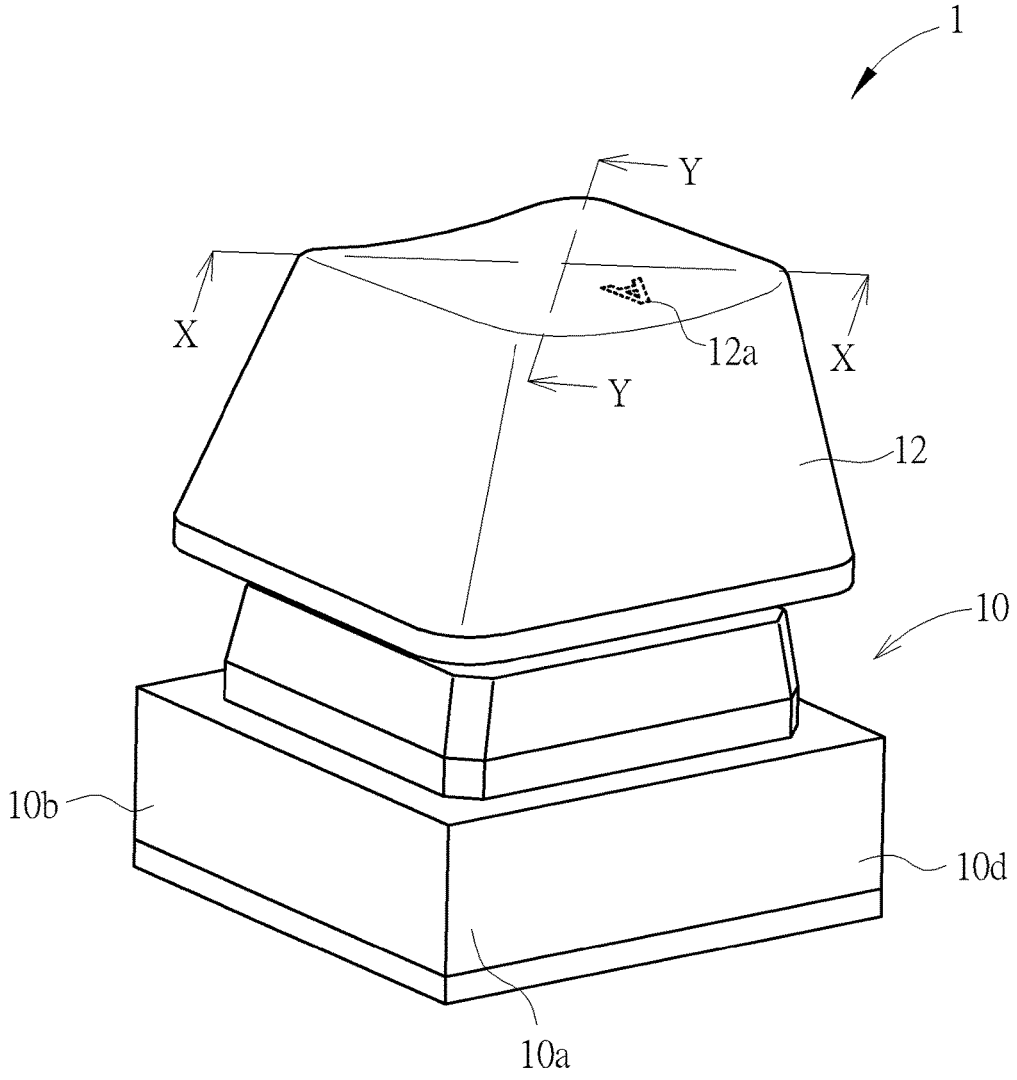
FIG. 1 is a schematic diagram illustrating a keyswitch of an embodiment according to the invention.
Figure 2:
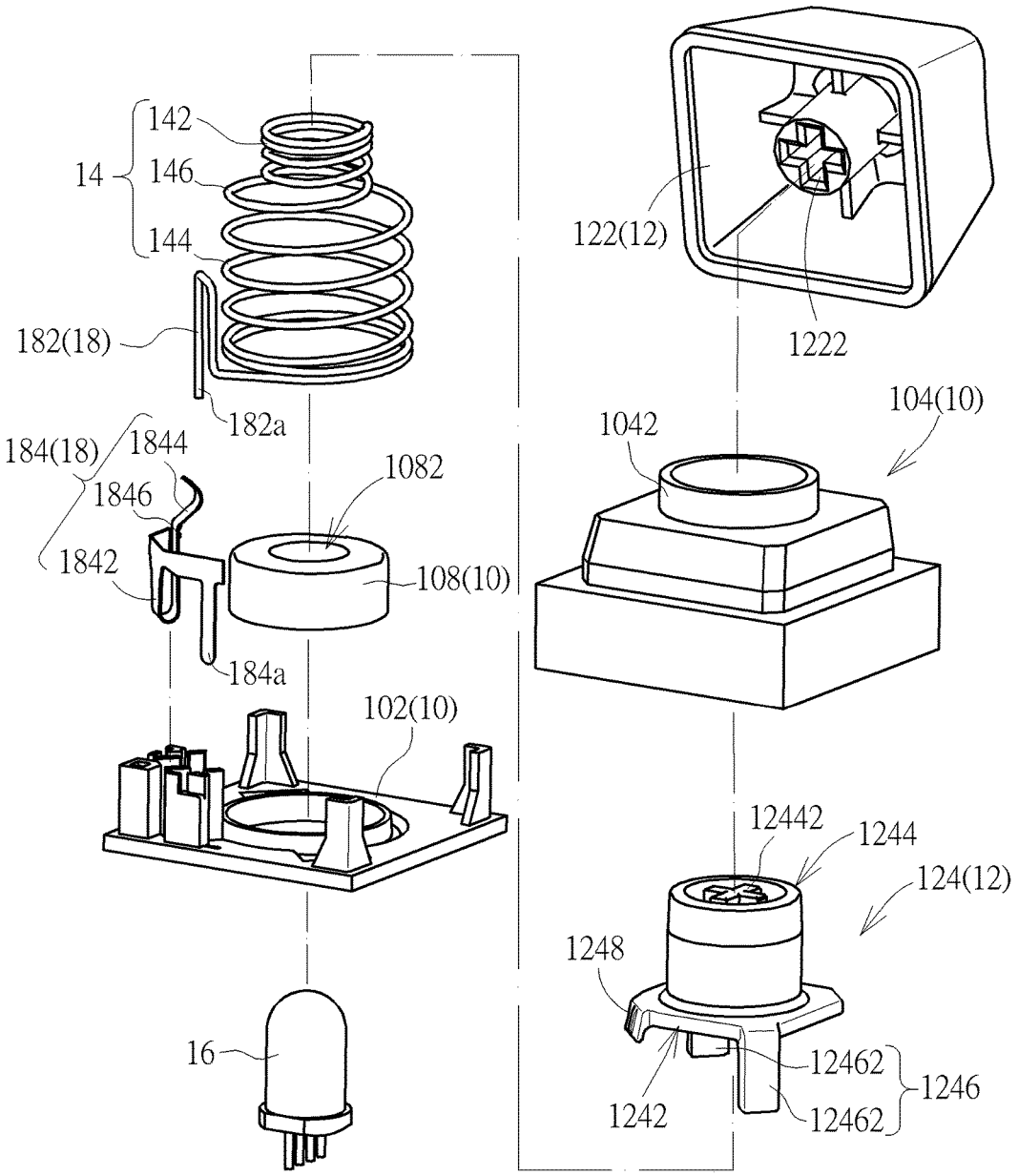
FIG. 2 is an exploded view of the keyswitch in FIG. 1 in a view point indicated by the line X-X.
Figure 3:
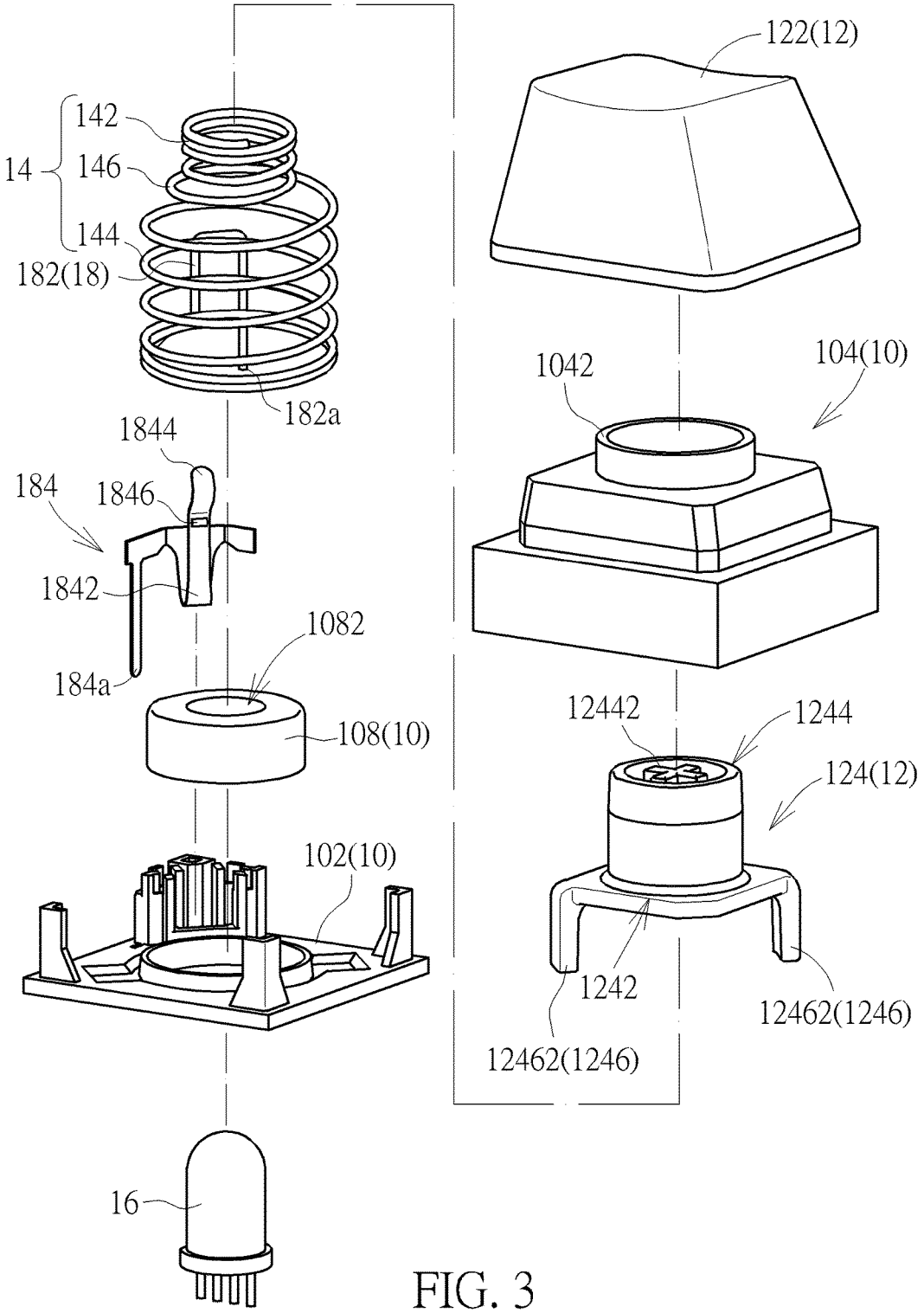
FIG. 3 is an exploded view of the keyswitch in FIG. 1 in a view point indicated by the line Y-Y.

Please refer to FIG. 1 to FIG. 5. A keyswitch 1 of an embodiment according to the invention includes a base 10, a keycap 12, a return force mechanism 14, a light source 16, and a switch 18. The keycap 12 is disposed above the base 10. The return force mechanism 14 is disposed between the base 10 and the keycap 12. By a sliding engagement of the base 10 with the keycap 12, the keycap 12 can move parallel to a direction D1 (indicated by an arrow in FIG. 4 and FIG. 5) selectively toward or away from the base 10. Therein, in the view point of FIG. 4 or FIG. 5, the direction D1 is substantially a vertical direction. In the embodiment, the return force mechanism 14 is a combination of springs which includes a first spring 142 and a second spring 144. The first spring 142 and the second spring 144 are connected in series and are disposed between the base 10 and the keycap 12. An upper end the first spring 142 is against the keycap 12. A lower end of the first spring 142 is connected to an upper end of the second spring 144. A lower end of the second spring 144 is against the base 10. Each of the first spring 142 and the second spring 144 is a coil spring including a plurality of elastic coils. When the keycap 12 begins to move from an initial position toward the base 10, the keycap 12 renders both the first spring 142 and the second spring 144 deform. A return force produced by the deformed first spring 142 and the deformed second spring 144 is taken as a return force for the keycap 12. The further details of the deformation of the first spring 142 and the second spring 144 will be described later. The light source 16 is disposed on the base 10 and can emit light toward the keycap 12. The keycap 12 can include a light penetrable portion 12*a* (indicated by dashed lines in FIG. 1). The light passing through the light penetrable portion 12*a* can produce a visual effect. For simplification of the drawings, the interior structure of the light source 16 is not shown in the figures in sectional view. In the embodiment, the light source 16 is realized by an LED light-emitting component having a light-emitting diode and a plurality of electrode pins. The switch 18 is disposed on the base 10 and is selectively triggered by the keycap 12. In addition, in practice, the light source 16 and the switch 18 are electrically connected to a circuit board 2 (indicated by a dashed rectangle in FIG. 4) in principle, which will not be described further.

For more details, the base 10 includes a base plate 102, an upper cover 104, a sliding engagement structure 106, and a boss 108. The upper cover 104 and the base plate 102 are engaged to form an accommodating space 110. The sliding engagement structure 106 is located in the accommodating space 110. The boss 108 is fixed on the base plate 102 and extends in accommodating space 110 toward the keycap 12. The upper cover 104 has a plunger sleeve 1042. The plunger sleeve 1042 forms a plunger hole at the center portion. The plunger hole connects the accommodating space 110.

The keycap 12 includes a cap body 122 and a plunger 124. The cap body 122 is disposed above the upper cover 104. The plunger 124 is disposed between the base plate 102 and the upper cover 104. The plunger 124 has a first end portion 1242 at its lower portion. The plunger 124 has a second end portion 1244 at its upper portion. The plunger 124 is connected to the cap body 122 through the second end portion 1244. In the embodiment, the second end portion 1244 of the plunger 124 and the cap body 122 are connected by an engagement of the engagement structures 12442 and 1222.

The plunger 124 of the keycap 12 slidably passes through the plunger sleeve 1042 of the base 10. The first end portion 1242 is located in the accommodating space 110 right above the boss 108. The annular inner side wall of the plunger sleeve 1042 can guide the second end portion 1244 of the plunger 124 to move up and down relative to the base 10. The first end portion 1242 of the plunger 124 includes a sliding engagement structure 1246. The sliding engagement structure 1246 and the sliding engagement structure 106 are slidably engaged so that the keycap 12 can more reliably and stably move up and down relative to the base 10.

The return force mechanism 14 (i.e. the combination of springs) is disposed in the accommodating space 110 and contacts between the plunger 124 and the base plate 102. The first spring 142 is against the first end portion 1242 of the plunger 124. The second spring 144 is against the base plate 102 and is sleeved on the boss 108. The light source 16 is disposed on the base plate 102 and extends through the boss 108 into the accommodating space 110. The boss 108 includes a receiving hole 1082 passing through the boss 108. The light source 16 passes through the receiving hole 1082 and extends upward into the combination of springs (or the second spring 144). The light source 16 emits toward the first end portion 1242, so that the light passes through the second spring 144 and the first spring 142, enters the plunger 124 through the first end portion 1242, and is then guided by the plunger 124 to emit toward the cap body 122.

Figure 4:
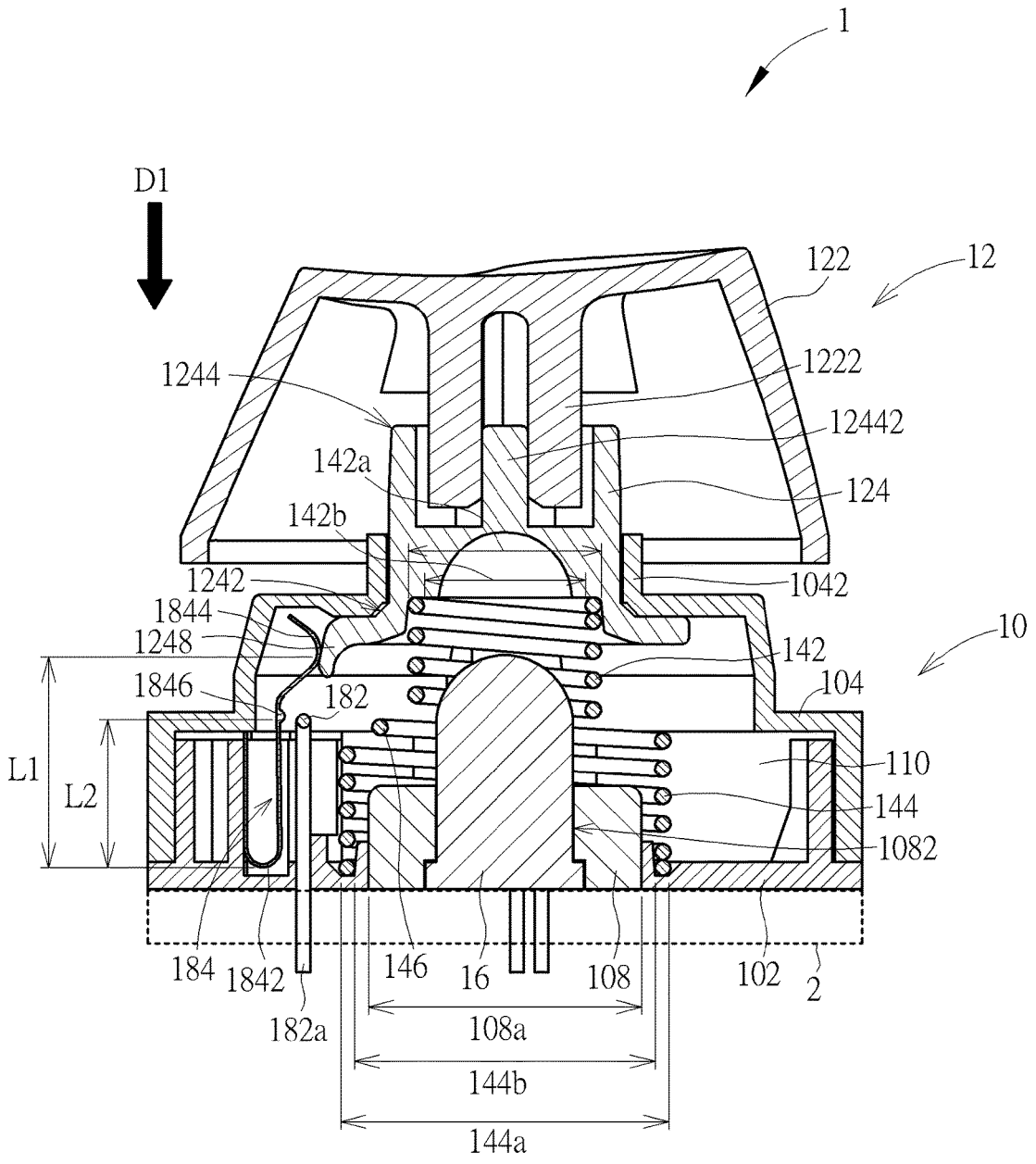
FIG. 4 is a sectional view of the keyswitch in FIG. 1 along the line X-X.
Figure 5:
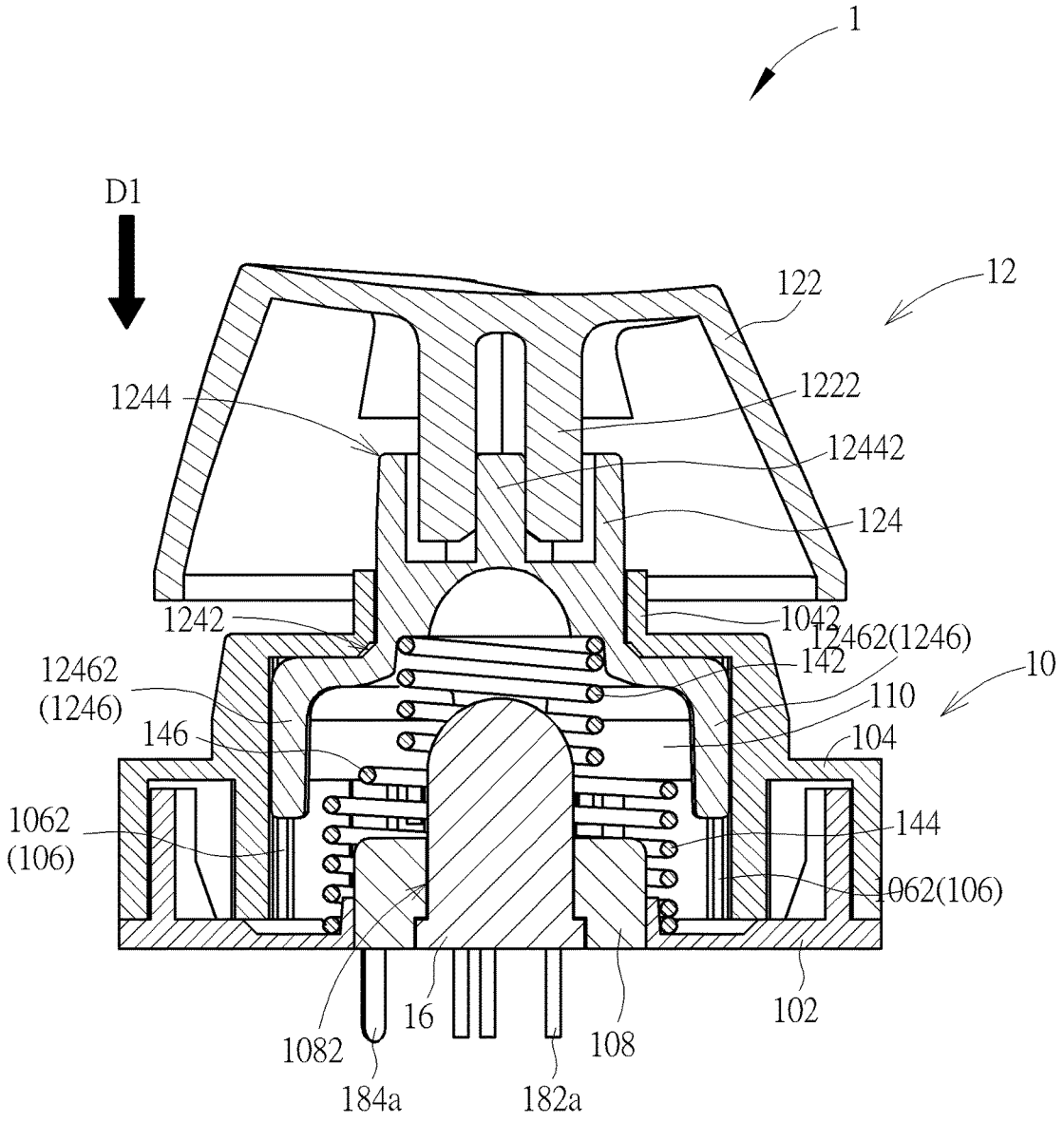
FIG. 5 is a sectional view of the keyswitch in FIG. 1 along the line Y-Y.

The switch 18 includes a fixed contacting part 182 and a movable contacting part 184 disposed neighboring to the fixed contacting part 182. The fixed contacting part 182 is directly fixed on the base plate 102. The fixed contacting part 182 is formed by an extension portion from the end of the second spring 144 that is against the base plate 102. The movable contacting part 184 is also fixed on the base plate 102 opposite to the fixed contacting part 182 and is a cantilever structure. However the invention is not limited thereto; for example, the fixed contacting part 182 is fixed on the base plate 102 independently from the second spring 144. The movable contacting part 184 can be realized by other elastic structure. Even the switch 18 can be realized by a common tact switch. Furthermore, in the embodiment, the fixed contacting part 182 and the movable contacting part 184 pass through the base plate 102 through the connection ends 182*a* and 184*a* respectively to be electrically connected to the circuit board 2 (as shown by FIG. 4). Thereby, the open and closed status of the switch 18 can be detected by the circuit board 2. The plunger 124 includes a triggering portion 1248 located at the first end portion 1242. The triggering portion 1248 selectively conducts or breaks the switch 18 depending on whether the keycap 12 is pressed or not. The portion of the fixed contacting part 182 which is used for contact the movable contacting part 184 can be treated with a surface treatment (e.g. electroplating nickel, gold) for an enhancement of fatigue resistance of the switch 18.

Figure 7:
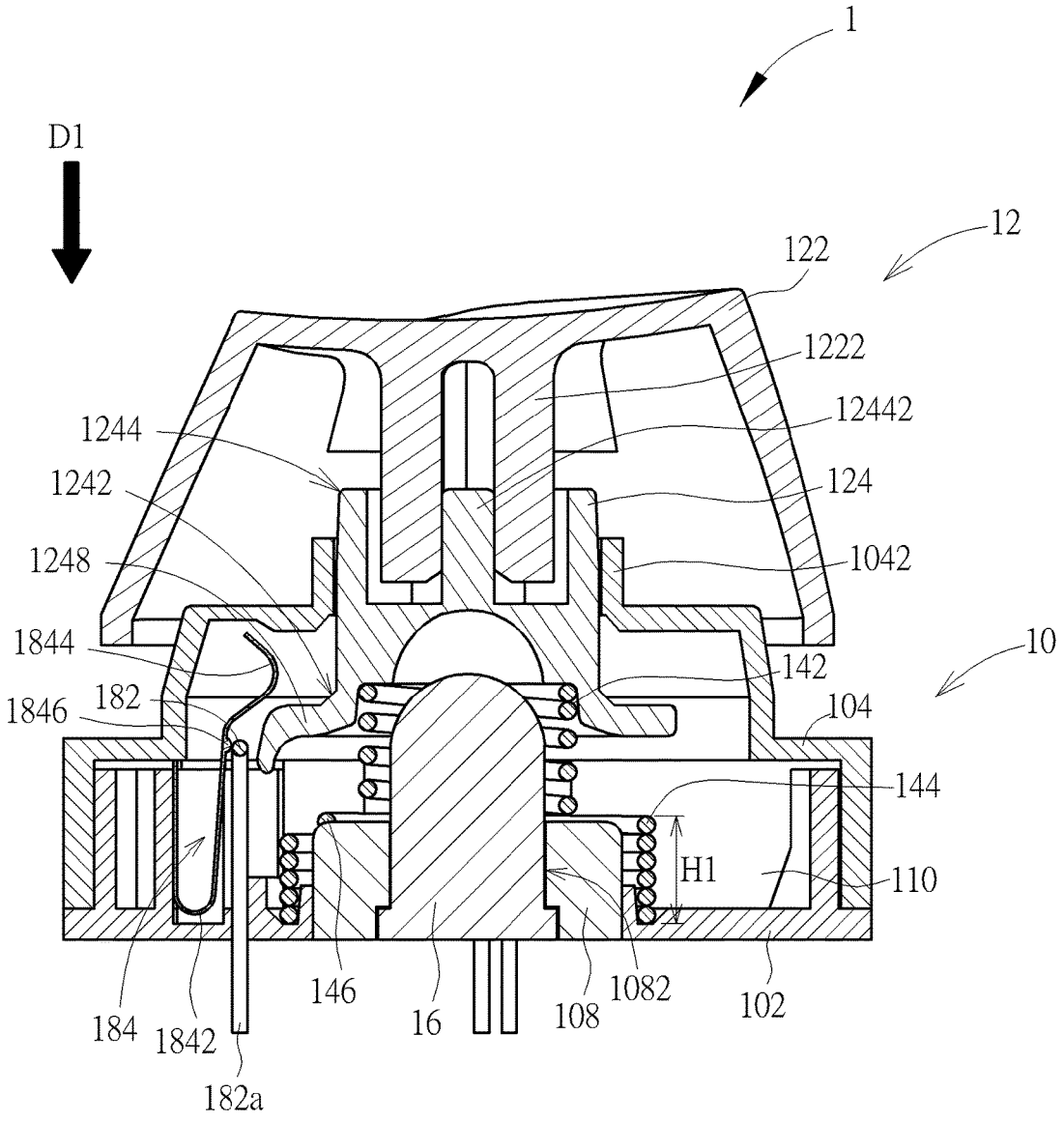
FIG. 7 is a sectional view of the keyswitch in FIG. 4 when the keycap is pressed to be located at a transition position.
Figure 8:
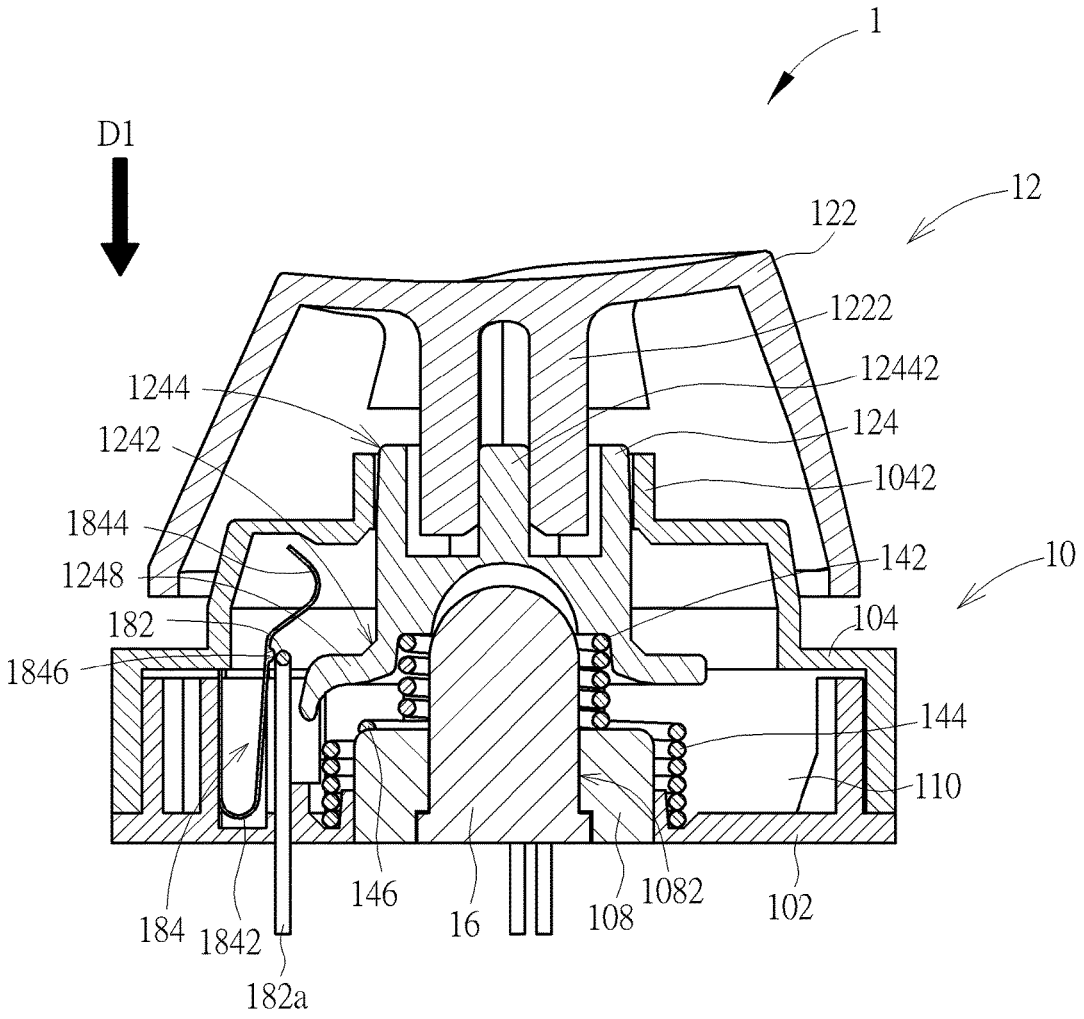
FIG. 8 is a sectional view of the keyswitch in FIG. 4 when the keycap is pressed to be located at a pressed position.

Please refer to FIG. 2, FIG. 4, FIG. 7 and FIG. 8. In the embodiment, the first spring 142 and the second spring 144 are connected vertically in series and are pre-pressed in the accommodating space 110, as shown by FIG. 4; at the moment, the keycap 12 is located at an initial position, and the keycap 12 is not pressed yet. When the keycap 12 receives a pressing force through the cap body 122 and then moves from the initial position toward the base 10, for example the user pressing the cap body 122 by a finger, the keycap 12 transfers the pressing force (indicated by an arrow in the figures) to the combination of springs (i.e. the return force mechanism 14). The pressing force is then transferred to the base 10 through the first spring 142 and the second spring 144 in order. Before the keycap 12 reaches a transition position (as shown by FIG. 7), both the first spring 142 and the second spring 144 elastically deform as the keycap 12 moves relative to the base 10. When the keycap 12 moves to the transition position, the second spring 144 is compressed to be solid such that a height of the second spring 144 reaches a corresponding solid height H1, as shown by FIG. 7. At the moment, the plurality of elastic coils of the second spring 144 substantially stack vertically; that is, any two adjacent elastic coils contact each other so that there is no gap for further elastic deformation. Therefore, the second spring 144 cannot elastically deform further even when the second spring 144 receives a larger compression force; that is, the second spring 144 is no longer elastically deformable. In the embodiment, in the second spring 144, any two adjacent elastic coils contact each other tight in the vertical direction (i.e. the compression and extension direction) so that there is no gap between the two adjacent elastic coils. Therefore, when the keycap 122 moves beyond the transition position, the second spring 144 no longer deforms, and the first spring 142 still can elastically deform as the keycap 12 moves toward the base 10. In the embodiment, when the keycap 122 proceeds to move to a pressed position, the first spring 142 is also compressed to be a corresponding solid height, as shown by FIG. 8. However, the invention is not limited thereto. For example, the keyswitch 1 also can be designed such that when the keycap 122 is at the pressed position, the first spring 142 is not compressed to be solid yet and is still elastically deformable.

In the embodiment, the first spring 142 has a first spring constant. The second spring 144 has a second spring constant. The first spring constant is different from the second spring constant. Therefore, when receiving the same pressing force, the first spring 142 and the second spring 144 produce different deformation amounts. By designing the allowable deformation amounts of the first spring 142 and the second spring 144, when the keycap 122 presses the combination of springs, one of the first and second springs 142 and 144 can be compressed to be solid first. In the embodiment, the first spring 142 and the second spring 144 are made of metal wires having the same wire diameter. The first spring 142 has a first coil outer diameter 142*a*. The second spring 144 has a second coil outer diameter 144*a*. The first coil outer diameter 142*a* is less than the second coil outer diameter 144*a*. The first spring 142 and the second spring 144 have the same pitch and length, so that the second spring constant is less than the first spring constant and the second spring 144 will be compressed to be solid first. Furthermore, the combination of springs includes a connection spring 146. The first spring 142 and the second spring 144 are connected through the connection spring 146. The connection spring 146 has a gradually-changing coil outer diameter, so that the first spring 142 and the second spring 144 can engage with each other smoothly in structure. Force can be smoothly transferred between the first spring 142 and the second spring 144. In principle, the gradually-changing coil outer diameter gradually varies from the first coil outer diameter 142*a* to the second coil outer diameter 144*a*. In the embodiment, the connection spring 146 is a coil spring of, but not limited to, a single coil. In addition, in practice, the connection spring 146 can be a connection part such as a section of metal wire connecting two ends of the first spring 142 and the second spring 144 at a side of the combination of springs, or two sections of metal wire connecting two ends of the first spring 142 and the second spring 144 at two opposite sides of the combination of springs, or a section of metal wire simultaneously connecting across the two end coils of the first spring 142 and the second spring 144. In addition, in the embodiment, the first spring 142 and the second spring 144 are coaxially disposed; that is, the extension axes of the two springs 142 and 144 overlap, but the invention is not limited thereto. For example, if the first spring 142 and the second spring 144 are disposed by an offset, the two opposite ends of the first spring 142 and the second spring 144 can be directly connected without the connection spring 146, so that the connection spring 146 can be omitted.

Furthermore, before the keycap 12 reaches the transition position, the elastic coefficient of the whole combination of springs is the reciprocal of the reciprocal sum of the first spring constant and the second spring constant, so the current elastic coefficient is less than the first spring constant and the second spring constant. When pressing the keycap 12, the user senses a light tactile feeling (i.e. a less force feedback) and can easily press down the keycap 12 quickly. When the keycap 12 moves beyond the transition position, the second spring 144 has been compressed to be solid, so the whole elastic coefficient is equal to the first spring constant; in other words, the whole elastic coefficient increases. At the moment, when pressing the keycap 12, the user senses a heavy tactile feeling (i.e. a larger force feedback) which leads to a larger return force. Therefore, the user can sense a light first and then heavy tactile feeling during a pressing on the keycap 12. In addition, in the embodiment, an outer diameter 108*a* of the boss 108 is less than a coil inner diameter 144*b* of the second spring 144. The outer diameter 180*a* of the boss 108 is larger than a first coil inner diameter 142*b* of the first spring 142. The size of the receiving hole 1082 is smaller than the first coil inner diameter 142*b* of the first spring 142, so that the boss 108 can effectively prevent the first spring 142 from moving downward; in another aspect, the size of the light source 16 is smaller than the first coil inner diameter 142*b* of the first spring 142. When the keycap 12 moves from the transition position to the pressed position (i.e. after moving toward the base beyond the transition position), although the second spring 144 is compressed to be solid and the height slightly protrudes out of the boss 108 relative to the base plate 102 (as shown by FIG. 7), the end of the first spring 142 that is connected to the second spring 144 also abuts against the boss 108, which is conducive to the stability of the elastic deformation of the first spring 142. However, the invention is not limited thereto. For example, the boss 108 is modified such that the height of the boss 108 is greatly reduced or the height of the second spring 144 after compressed to be solid is obviously higher than the boss 108. In this case, the first spring 142 will not abut against the boss 108 in principle but still can elastically deform as the keycap 12 moves toward the base plate 102. In addition, in practice, the boss 108 thereon can form a release space so as not to interfere with the connection spring 146, so that the second spring 144 after being compressed to be solid can be lower than the boss 108, in which the first spring 142 still can abut against the boss 108 stably without slanting.

In addition, based on the foregoing description, in practice, the combination of springs can be modified such that the first spring 142 will be compressed to be solid first during a pressing on the keycap, which also can provide a light first and then heavy pressing feeling. For example, by disposing the combination of springs in the above embodiment upside down, the spring constant the upper spring (i.e. the second spring 144) of the combination of springs is relatively less and will reach the solid status first. Alternatively, it is applicable to make the upper spring reach the solid status first by modifying the springs in length, wire diameter, pitch and so on; in this case, it is not limited to that the spring constant of the compressed spring reaching the solid status is relatively less. Similarly, the above modification means also can be applied to the above-mentioned combination of springs (i.e. the return force mechanism 14) such that the second spring 144 can reach the solid status first (i.e. the solid height H1).

Figure 9:
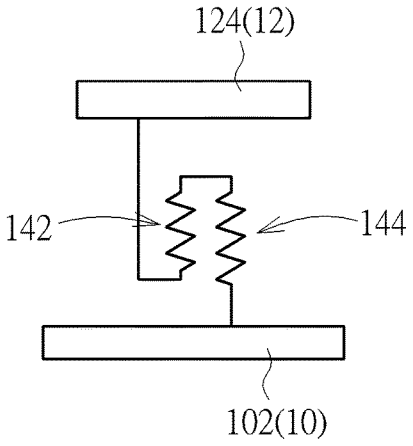
FIG. 9 is a schematic diagram illustrating a disposition of a combination of springs, a plunger, and a base plate according to another embodiment.
Figure 10:
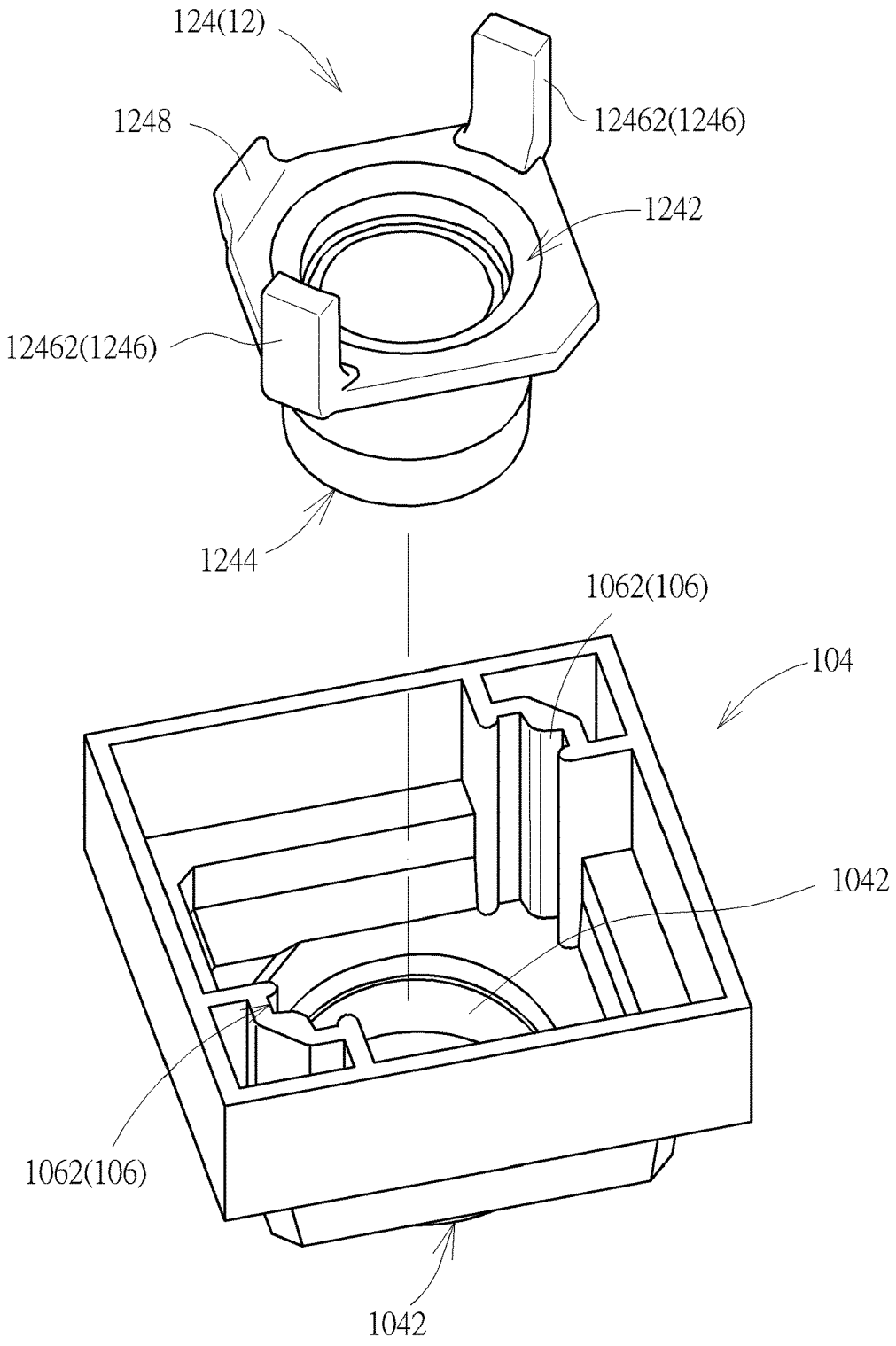
FIG. 10 is a schematic diagram illustrating the assembly of an upper cover and a plunger of the keyswitch in FIG. 2 in another view point.
Figure 11:
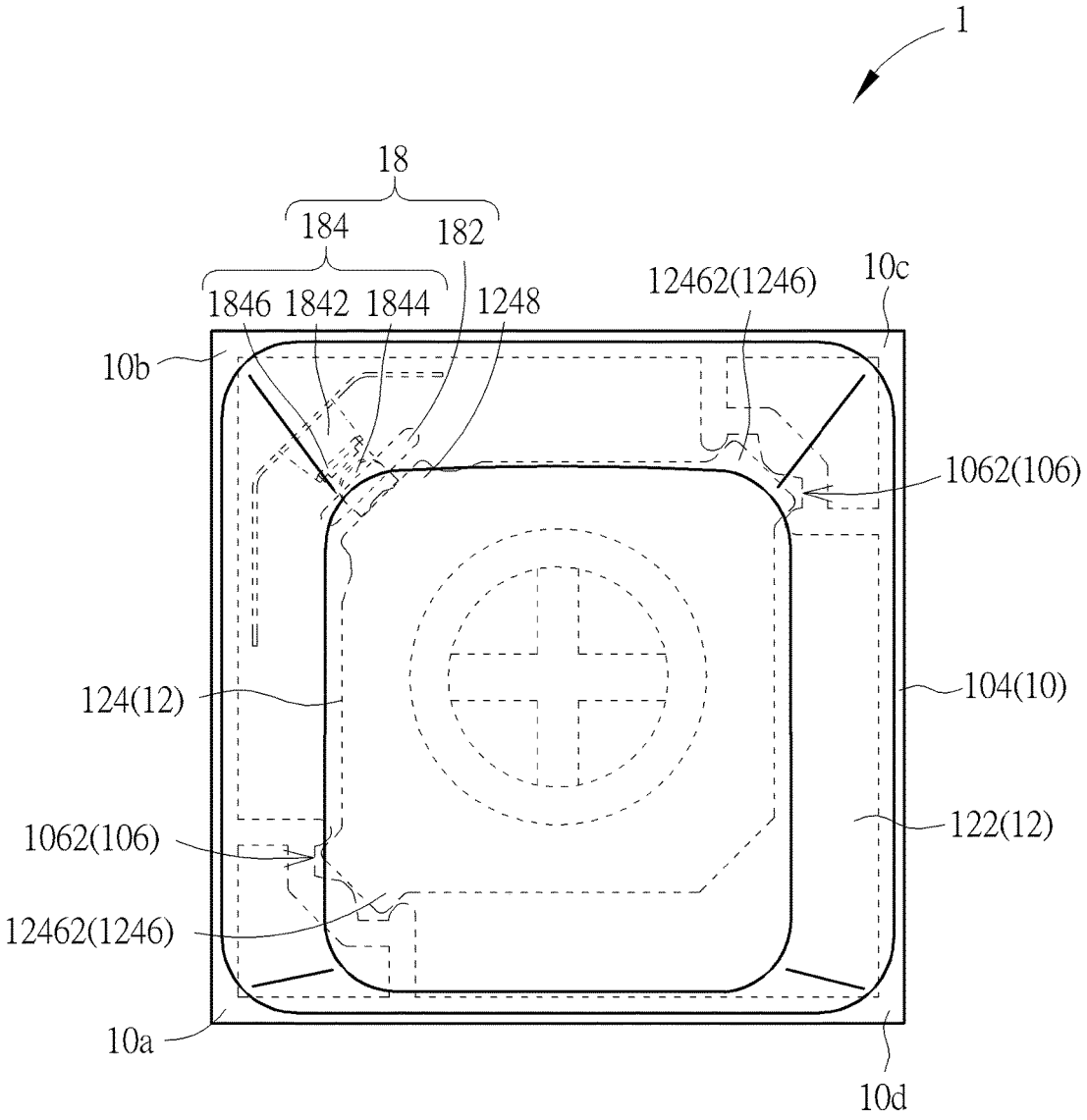
FIG. 11 is a top view of the keyswitch in FIG. 1.

In addition, in the embodiment, the serial connection of the first spring 142 and the second spring 144 is realized by arranging the first spring 142 and the second spring 144 in a line in order and connecting, so when the keycap 12 moves toward the base 10, the force applied to the combination of springs by the keycap 12 renders both the first spring 142 and the second spring 144 be compressed; however, the invention is not limited thereto. As shown by FIG. 9, according to another embodiment, the first spring 142 and the second spring 144 are arranged in parallel but in structural logic are connected in series. That is, the force applied by the keycap 12 is still transferred from the first spring 142 to the second spring 144 and then transferred to the base 10. In practice, the first spring 142 and the second spring 144 in FIG. 9 can be disposed by sliding one into the other; for example, because of the smaller coil outer diameter, the first spring 142 can extends into the second spring 144 and is still connected to the second spring 144 in series in structure. In FIG. 9, when the keycap 12 moves from the initial position toward the base 10, the first spring 142 is deformed to stretch while the second spring 144 is deformed to shrink and is compressible to be the corresponding solid height. Similarly, the above-mentioned description about the reverse disposition of the combination of springs is also applicable herein and will not be described in addition.

In the keyswitch 1, the combination of springs is realized by two springs connected in series (i.e. the first spring 142 and the second spring 144), but the invention is not limited thereto. In practice, the combination of springs can include more springs, so that the whole elastic coefficient of the combination of springs varies by a plurality of sections. The elastic coefficient of each section is a constant. The whole elastic coefficient of the combination of springs increases as the amount of the springs which are compressed to be solid increases. Furthermore, each one of the series of the springs is not limited to a single structure; for example, two springs connected in parallel as a whole also can be treated as one of the series of the springs. Furthermore, in the keyswitch 1, the spring constant of the second spring 144 is less than the spring constant of the first spring 142, so the elastic coefficient of the whole combination of springs is less than the spring constant of the second spring 144 before the second spring 144 is compressed to be solid. After the second spring 144 is compressed to be solid, the elastic coefficient of the whole combination of springs is equal to the spring constant of the first spring 142 (larger than the spring constant of the second spring 144), so the user can sense a clear difference in the tactile feeling (i.e. after and before the keycap 12 reaches the transition position). The feeling difference can help the keyswitch 1 to provide the user information about the location of the keycap 12 through the force feedback. For example, thereby the user can roughly know whether the keycap 12 is effectively pressed (e.g. whether the switch 18 is triggered).

Please refer to FIG. 2, FIG. 4, FIG. 7 and FIG. 8. In the embodiment, the movable contacting part 184 has a fixed end 1842, a free end 1844, and a contacting portion 1846. The movable contacting part 184 is fixed on the base plate 102 through the fixed end 1842. The contacting portion 1846 is located between the fixed end 1842 and the free end 1844 and is used for electrically contacting the fixed contacting part 182. The triggering portion 1248 pushes movable contacting part 184 the through the free end 1844.

As shown by FIG. 4, when the keycap 12 is not pressed yet and is located at the initial position, the movable contacting part 184 is pushed by the triggering portion 1248 and has elastically deformed. Therein, the triggering portion 1248 pushes against the free end 1844 of the movable contacting part 184 so that the contacting portion 1846 of the movable contacting part 184 and the fixed contacting part 182 are separate; thereby, the switch 18 remains open.

Figure 6:
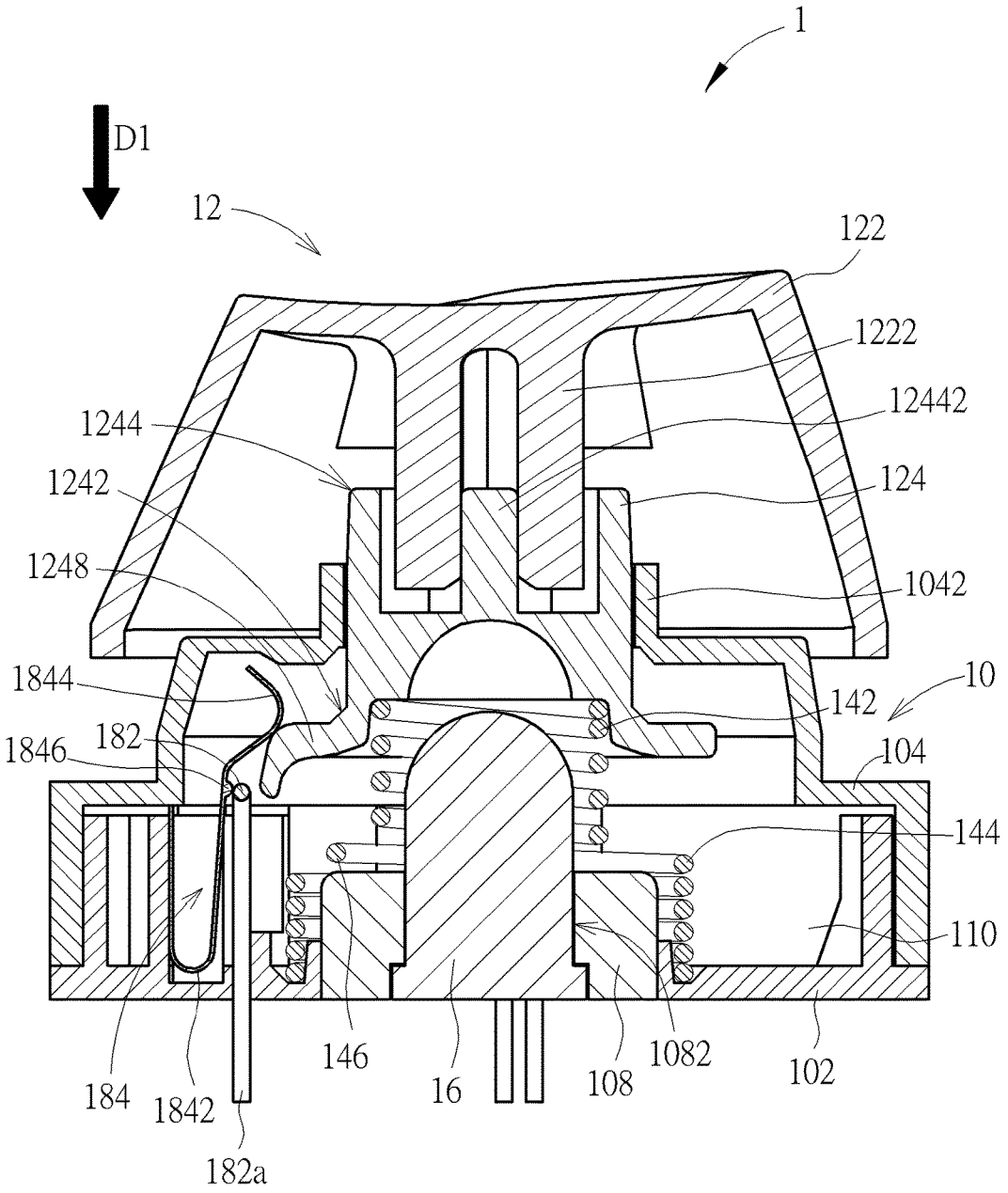
FIG. 6 is a sectional view of the keyswitch in FIG. 4 when a keycap thereof is pressed to be located at a triggering position.

As shown by FIG. 6, when the keycap 12 is pressed to move toward the base 10 beyond a triggering position, the triggering portion 1248 and the free end 1844 of the movable contacting part 184 are separate so that the movable contacting part 184 moves due to a resilient force to contact the fixed contacting part 182 through the contacting portion 1846; thereby, the switch 18 is conducted. In the embodiment, the triggering position is located between the initial position (as shown by FIG. 4) and the transition position (as shown by FIG. 7), so that when the switch 18 is conducted (that is when the keycap 12 reaches the triggering position, the contacting portion 1846 of the movable contacting part 184 contacts the fixed contacting part 182), the keycap 12 still can proceed to move downward to the transition position (as shown by FIG. 7) under a condition that the second spring 144 is not compressed to be solid yet. For example, it is applicable to design the triggering position for conducting the switch 18 to be a position below the initial position by 1.8 to 2.0 mm and to design the transition position at which the second spring 144 is compressed to be solid to be a position below the initial position by 3.0 to 3.5 mm. In this embodiment, after the switch 18 is conducted, the second spring 144 is not compressed until the keycap 12 proceeds to move downward by at least 1 mm.

Thereby, in the movement of the keycap 12 moving from the initial position to the transition position, the combination of springs provides a less elastic coefficient, so the user can sense a light tactile feeling and easily press down the keycap 12 quickly to trigger the switch 18. Furthermore, when the keycap 12 proceeds to move downward to the pressed position, the combination of springs provides a larger elastic coefficient so that the return force mechanism 14 (i.e. the combination of springs) provides a larger return force. At the moment, the user can sense a variation of the tactile feeling through the pressing feeling to the switch 18, so that the user knows that the switch 18 is conducted and then moves his finger away from the keycap 12 for stopping applying the pressing force. Therefore, the keycap 12 can return its original position (i.e. the initial position) quickly. Such keyswitch action is special: (1) before the switch is conducted, the elastic coefficient of the combination of springs is relatively less, so the user can sense a light resistance by his finger and easily make the switch be conducted quickly; (2) after the switch is conducted (more precisely, when the keycap 12 moves beyond the transition position), the elastic coefficient of the combination of springs increases, so that the keycap 12 can quickly return to the initial position after the user stop pressing the keycap 12. Thereby, the user can easily press the keycap 12 in a higher pressing frequency, e.g. in a computer game of electronic sports; furthermore, a fatigue to his finger due to an excessively exerting resulting in incapability of playing the computer game for a long time can be avoided.

Furthermore, in the embodiment, the movable contacting part 184 is provided in a U-shaped structure with an opening upward, so the cantilever structure extends substantially parallel to the movement direction of the keycap 12 and the movable contacting part 184 has a longer cantilever. In other words, the movable contacting part 184 can be triggered by a less triggering force. Furthermore, relative to the deflection pivot of the movable contacting part 184, the position (corresponding to a distance L1) at which the triggering portion 1248 contacts the free end 1844 is farther than the position (corresponding to a distance L2) at which the fixed contacting part 182 contacts the contacting portion 1846 (i.e. the distance L1 is longer than the distance L2), so the keycap 12 can trigger the triggering portion 1248 by a less triggering force by the law of the lever so as to break the shorted switch 18. Furthermore, even if the contacting position at which the triggering portion 1248 contacts the movable contacting part 184 may vary slightly (e.g. because the plunger 124 moves up and down slightly obliquely relative to the direction D1), the influence due to the position variation on the contacting position at which the movable contacting part 184 contacts the fixed contacting part 182 will be reduced so that the fixed contacting part 182 still can effectively electrically contact the contacting portion 1846 of the movable contacting part 184. In other words, in the embodiment, the disposition of the switch 18 and the triggering portion 1248 is conducive to enhancement of the tolerance to the assembly and action of the keyswitch 1. In addition, in the embodiment, the movable contacting part 184 horizontally deflects when in operation. The triggering force is a horizontal lateral force in principle, which is conducive to reduction in the influence on the up and down movement of the keycap 12 relative to the base 10.

Please refer to FIG. 1, FIG. 2, FIG. 5, FIG. 7 (or FIG. 8), FIG. 10, and FIG. 11. Therein, in FIG. 11, the sliding engagement structures 106 and 1246, the triggering portion 1248, and the switch 18 are shown by their outlines in dashed lines. In the embodiment, the base 10 has a rectangle projection outline. The base 10 has sequentially positioned a first corner 10*a*, a second corner 10*b*, a third corner 10*c*, and a fourth corner 10*d*. The sliding engagement structure 106 of the base 10 includes two first sliding parts 1062 which are realized by sliding slots and are structurally integrated into the upper cover 104. The two first sliding parts 1062 are located at the first corner 10*a* and the third corner 10*c* respectively. The sliding engagement structure 1246 of the keycap 12 includes two second sliding parts 12462 which are realized by sliding blocks corresponding to the first corner 10*a* and the third corner 10*c* respectively. The two first sliding parts 1062 and the two second sliding parts 12462 engaged with each other, so that a movement of the keycap 12 between the initial position and the pressed position is a linear movement (or one-dimensional movement). The switch 18 is located at the second corner 10*b*. The triggering portion 1248 corresponds to the second corner 10*b*. Therefore, the sliding engagement structures 106 and 1246, the triggering portion 1248, and the switch 18 are disposed corresponding to the corners 10*a-c* of the base 10, so compared with other portions of the base 10, e.g. a side portion of the base 10 between the corners 10*a* and 10*b*, the corners 10*a-c* can provide relative larger spaces for disposing the structures and enhance the reliability and stability of the action of these structures. In addition, in the embodiment, the first sliding parts 1062 are realized by sliding slots; the second sliding parts 12462 are realized by sliding blocks. However, in practice, they can exchange. That is, the first sliding parts 1062 are realized by sliding blocks; the second sliding parts 12462 are realized by sliding slots, which also can perform the effect of slidably engaging with each other and guiding the keycap 12 to move up and down relative to the base 10.

Figure 12:
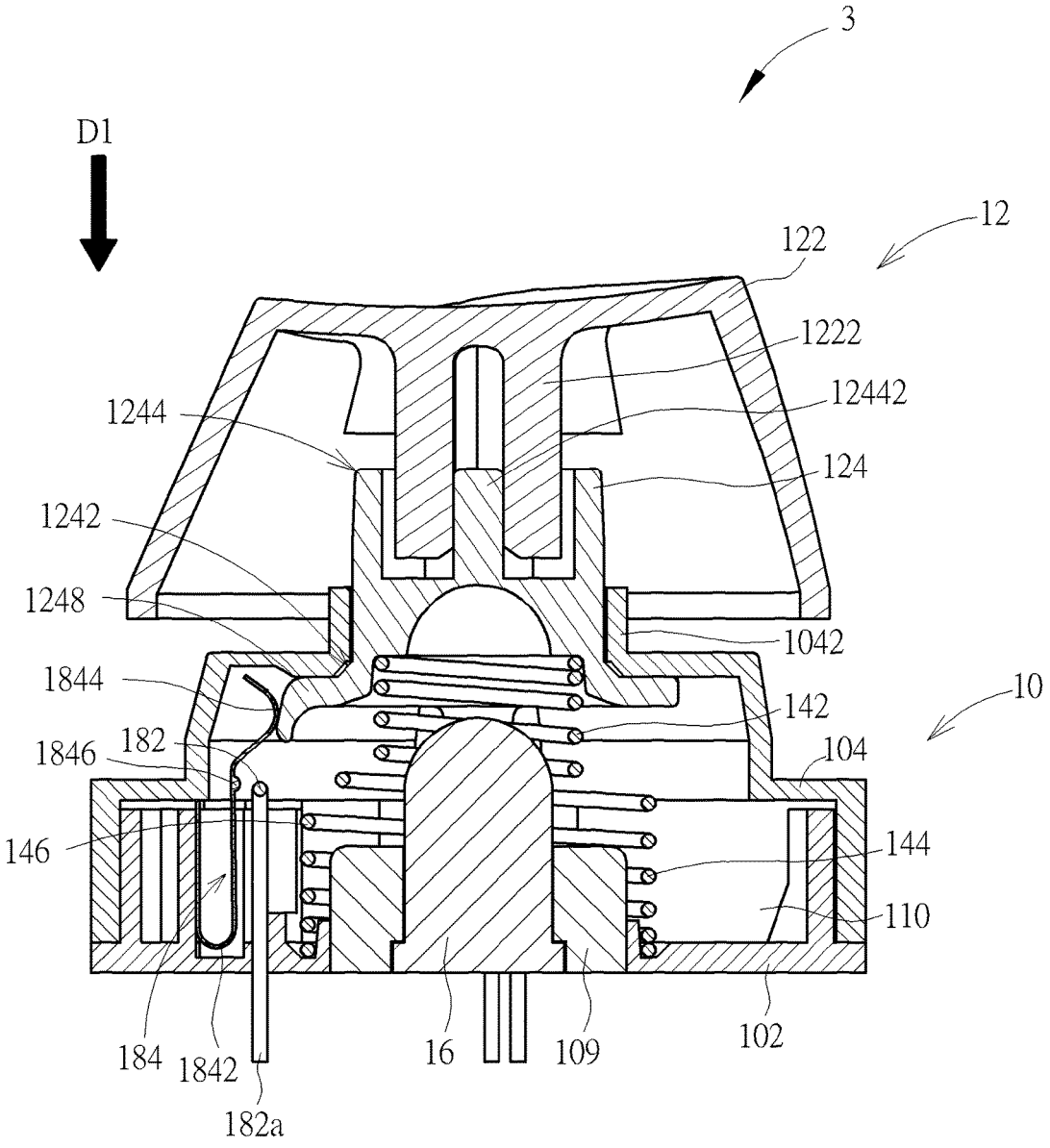
FIG. 12 is an exploded view of a keyswitch of another embodiment according to the invention.
Figure 13:
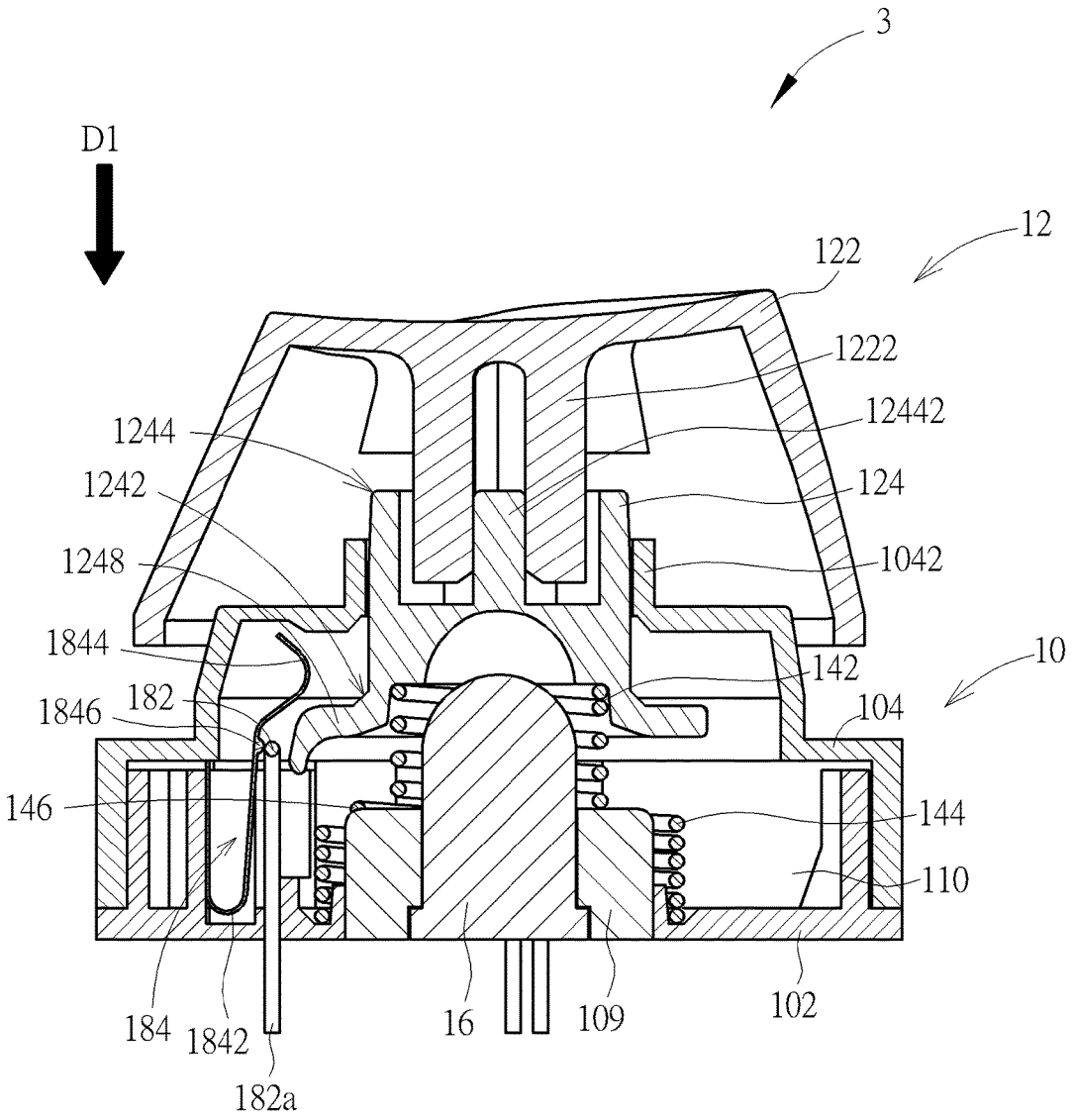
FIG. 13 is a sectional view of the keyswitch in FIG. 12 when a keycap thereof is pressed to be located at a transition position.
Figure 14:
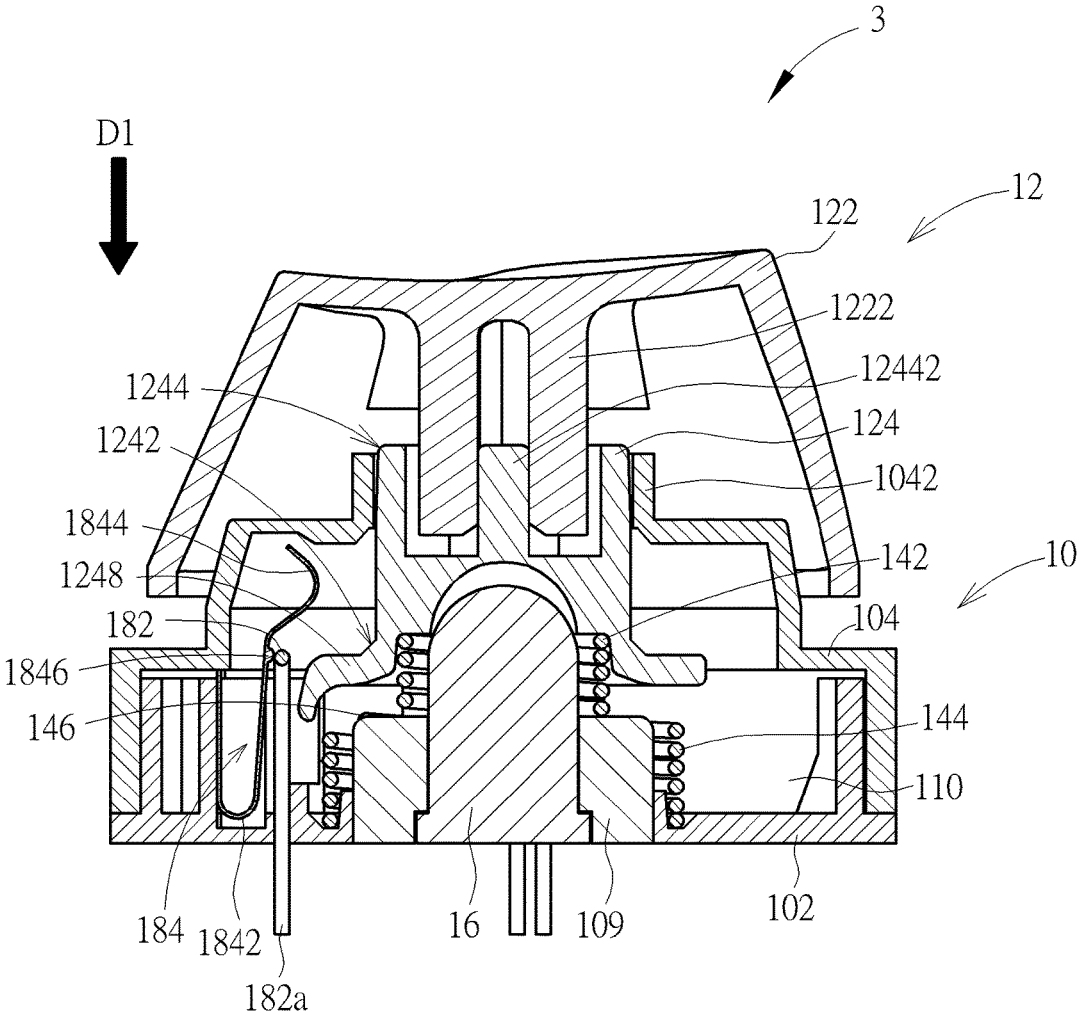
FIG. 14 is a sectional view of the keyswitch in FIG. 12 when the keycap is pressed to be located at a pressed position.
Figure 15:
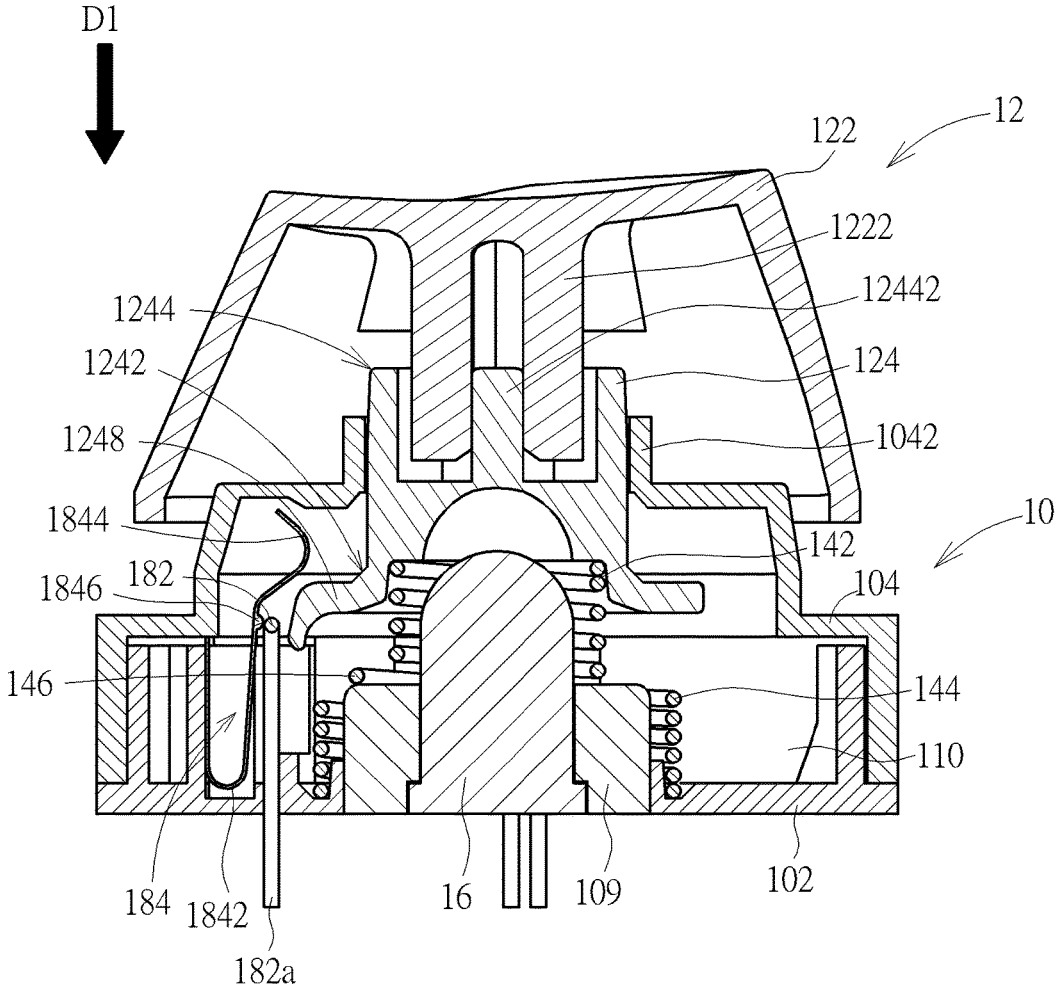
FIG. 15 is a sectional view of a keyswitch of another embodiment according to the invention when a keycap thereof is pressed to be located at a transition position.

As described above, in the keyswitch 1, during the elastic deformation of the combination of springs (i.e. the return force mechanism 14), the combination of springs uses one of the springs (i.e. the second spring 144) to be compressed solid so that the whole elastic coefficient of the combination of springs changes; however, the invention is not limited thereto. Please refer to FIG. 12 to FIG. 14, which are sectional views of a keyswitch 3 of another embodiment according to the invention for illustrating a continuous pressing action of the keyswitch 3. The keyswitch 3 is substantially similar in structure to the keyswitch 1, so the keyswitch 3 continues using the reference numbers used in the keyswitch 1. The components in the keyswitches 1 and 3 having the same reference numbers perform the same functions. In addition to the following descriptions, for other descriptions for the keyswitch 3, please refer to the relevant descriptions of the keyswitch 1, which will not be described in addition. A difference between the keyswitch 3 and the keyswitch 1 is that when the keycap 12 moves from an initial position toward the base 10 to a transition position (as shown by the keyswitch 3 from the status shown by FIG. 12 to the status shown by FIG. 13), the keyswitch 3 uses a stop part 109 to interfere with the combination of springs (i.e. the return force mechanism 14) such that the second spring 144 is prevented from continuing elastically deforming, instead of compressing the second spring 144 to be solid so that the second spring 144 is prevented from continuing elastically deforming. Therefore, when the keycap 12 moves from the initial position toward the base 10 beyond the transition position, the stop part 109 and the combination of springs produce a structural interference therebetween, so that one of the first spring 142 and the second spring 144 can deform further, and the other one of the first spring 142 and the second spring 144 still can elastically deform as the keycap 12 proceeds to move toward the base 10. Thereby, the combination of springs of the keyswitch 3 also can provide the user a light tactile feeling (i.e. a less force feedback) before the keycap 12 reaches the transition position, and also can provide the user a heavy tactile feeling (i.e. a larger force feedback) after the keycap 12 is beyond the transition position. In the keyswitch 3, the stop part 109 is disposed on the base plate 102 of the base 10 and is equivalent to the boss 108 of the keyswitch 1. The stop part 109 also has the same function to the combination of springs as the boss 108 does in the keyswitch 1. Furthermore, in more details, in the keyswitch 3, when the keycap 12 moves from the initial position toward the base 10 beyond the transition position (as shown by the keyswitch 3 from the status shown by FIG. 13 to the status shown by FIG. 14), the first spring 142 abuts against the stop part 109, which leads to the effect of the stop part 109 structurally interfering with the combination of springs such that the second spring 144 can no longer elastically deform as the keycap 12 proceed to move downward, but the first spring 142 still can elastically deform as the keycap 12 proceed to move downward. Furthermore, in practice, the stop part 109 thereon can form a release space for accommodating the connection spring 146, so that the first spring 142 can abut against the stop part 109 more stably. In addition, in practice, the stop part 109 also can prevent the second spring 144 from proceeding to elastically deform by abutting against the connection spring 146. As shown by FIG. 15, the connection spring 146 abuts against the stop part 109, so that the second spring 144 does not elastically deform further, but the first spring 142 still can proceed to elastically deform. Furthermore, in FIG. 15, the connection spring 146 can be replaced with a section of metal wire connecting two ends of the first spring 142 and the second spring 144 at a side of the combination of springs, or two sections of metal wire connecting two ends of the first spring 142 and the second spring 144 at two opposite sides of the combination of springs, or a section of metal wire simultaneously connecting across the two end coils of the first spring 142 and the second spring 144.

Figure 16:
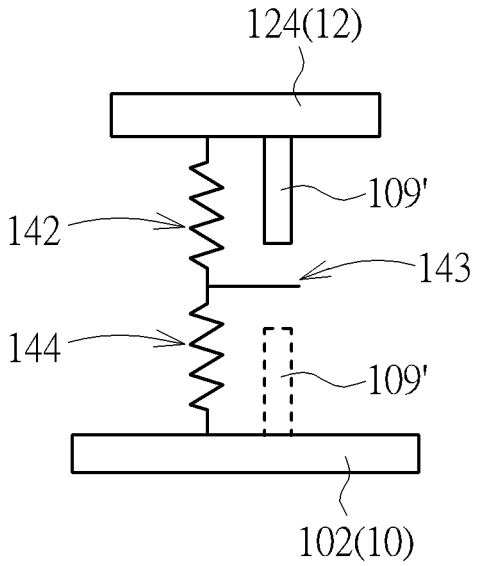
FIG. 16 is a schematic diagram illustrating a disposition of a combination of springs, a plunger, and a base plate according to another embodiment.
Figure 17:
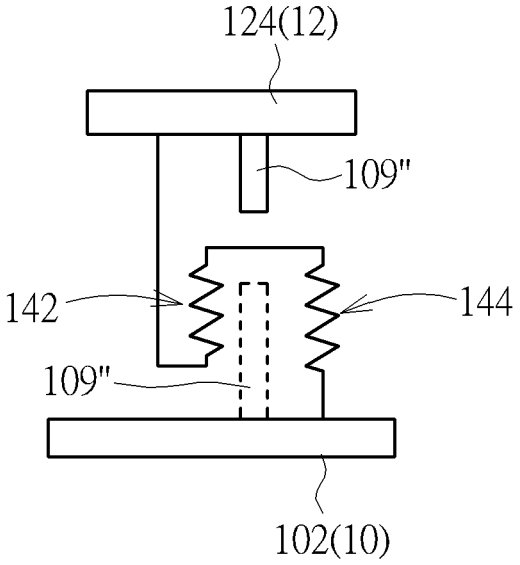
FIG. 17 is a schematic diagram illustrating a disposition of a combination of springs, a plunger, and a base plate according to another embodiment.
Figure 18:
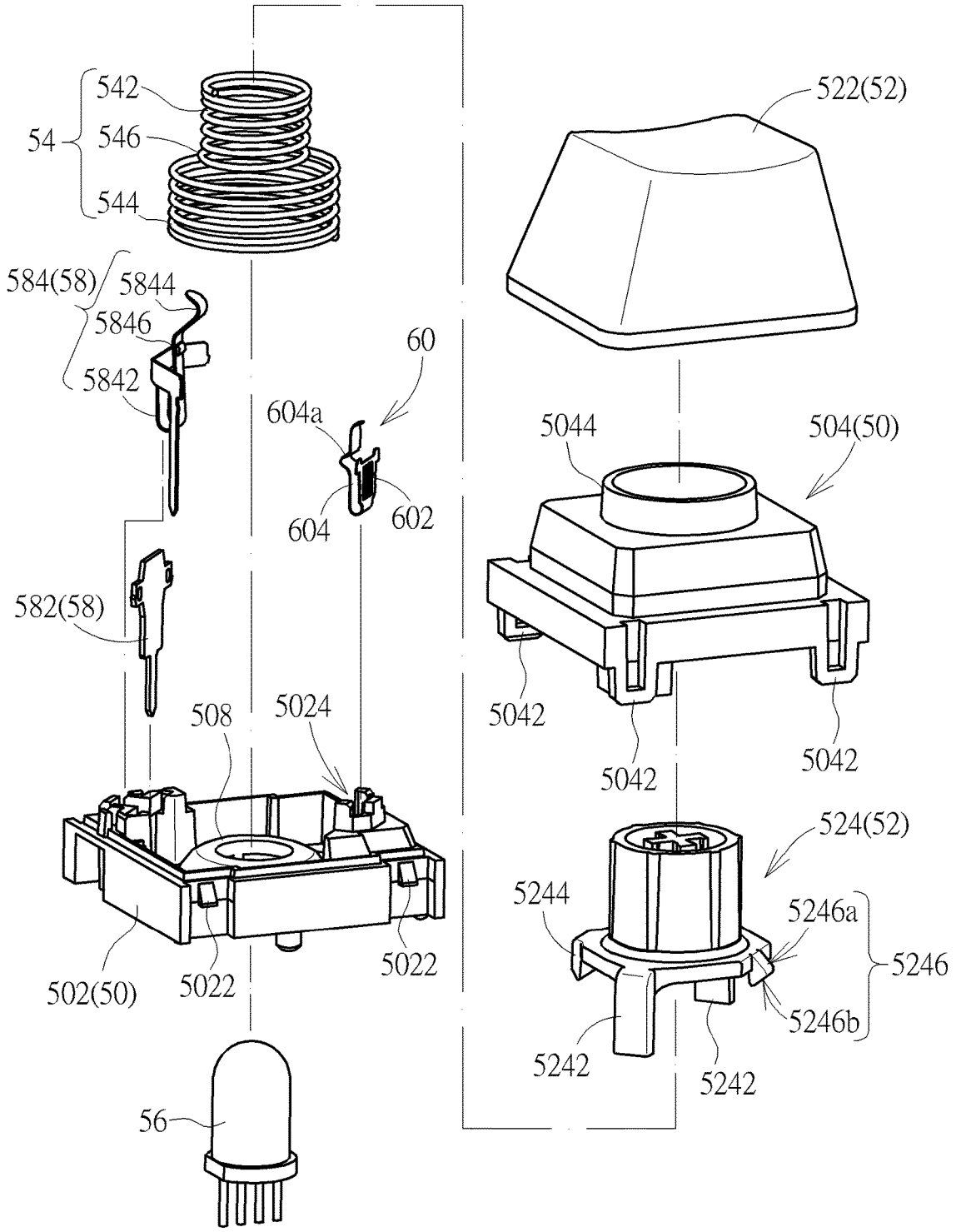
FIG. 18 is an exploded view of a keyswitch of another embodiment according to the invention.

In the embodiment, the stop part 109 is disposed on the base 10 to stop the second spring 144; however, the invention is not limited thereto. For example, the stop part 109 can be used for stop the upper spring (i.e. the second spring 144 under the reverse disposition of the combination of springs) by disposing the combination of springs of the keyswitch 3 upside down and disposing the stop part 109 on the plunger 124. For another example, as shown by FIG. 16, a stop part 109' is disposed on the keycap 12. A push-against part 143 is disposed between the first spring 142 and the second spring 144 for cooperating with the stop part 109'. When the keycap 12 moves downward to the transition position, the stop part 109' abuts against the push-against part 143, so that the first spring 142 can no longer elastically deform as the keycap 12 proceed to move downward, but the second spring 144 still can elastically deform as the keycap 12 proceed to move downward. In practice, the stop part 109' can be modified to be disposed on the base 10 (as shown by dashed lines in FIG. 16). In this case, when the keycap 12 moves downward to the transition position, the stop part 109' abuts against the push-against part 143, so that the second spring 144 can no longer elastically deform as the keycap 12 proceed to move downward, but the first spring 142 still can elastically deform as the keycap 12 proceed to move downward. For another example, as shown by FIG. 17, a stop part 109" is disposed on the keycap 12. When the keycap 12 moves downward from the initial position, the first spring 142 is deformed to stretch while the second spring 144 is deformed to shrink. When the keycap 12 moves downward to the transition position, the stop part 109" abuts against the combination of springs (or the location where the first spring 142 and the second spring 144 are connected), so that the first spring 142 can no longer elastically deform as the keycap 12 proceed to move downward, but the second spring 144 still can elastically deform as the keycap 12 proceed to move downward. In practice, the stop part 109" can be modified to be disposed on the base 10 (as shown by dashed lines in FIG. 17). In this case, when the keycap 12 moves downward to the transition position, the stop part 109" abuts against the combination of springs (or the location where the first spring 142 and the second spring 144 are connected), so that the second spring 144 can no longer elastically deform as the keycap 12 proceed to move downward, but the first spring 142 still can elastically deform as the keycap 12 proceed to move downward.

According to the descriptions of the keyswitches 1 and 3, no matter by means of compressing one spring to be solid or using the stop part to stop continuing deforming of one spring, in logic, they both render one spring of the combination of springs no longer proceed to elastically deform as the keycap moves toward the base when the keycap reaches a specific position (e.g. the transition position), so that the whole elastic coefficient of the combination of springs varies (from small to large) and the user can sense a light first and then heavy tactile feeling during a pressing on the keycap. When the keycap moves from the initial position to the transition position, the user can sense a light tactile feeling, so that the user can press the keyswitch quickly. In practice, the switch of the keyswitch can be designed to be triggered during the movement of the keycap from the initial position to the transition position, so that the switch is also triggered quickly. When the keycap moves beyond the transition position, the user can sense a heavy tactile feeling; that is, the keycap receives a larger return force. When the user stops pressing the keycap, the keycap can return quickly which is conducive to a next pressing on the keycap. Furthermore, in practice, based on the above design of the switch, when sensing the heavy tactile feeling, the user can know that the switch is triggered and does not need to press the keycap excessively.

Please refer to FIG. 18 to FIG. 25. A keyswitch 5 of another embodiment according to the invention includes a base 50, a keycap 52, a return force mechanism 54, a light source 56, a switch 58, and an elastic piece 60. The keycap 52 is disposed above the base 50. The return force mechanism 54 is disposed between the base 50 and the keycap 52. By a sliding engagement of the base 50 with the keycap 52, the keycap 52 can move parallel to the vertical direction selectively toward or away from the base 10. In the embodiment, the return force mechanism 54 is a combination of springs. When the keycap 52 moves toward the base 50, the keycap 52 deforms the combination of springs to produce a return force which is taken for driving the keycap 52 to move upward to its original position. The light source 56 is disposed on the base 50 and can emit light toward the keycap 52 to produce a visual effect. The switch 58 is disposed on the base 50 and is selectively triggered by the keycap 52. The elastic piece 60 is disposed on the base 50. The keycap 52 selectively contacts the elastic piece 60. On the whole, the keyswitch 5 is substantially similar in structure to the keyswitch 1. For other descriptions for the components of the keyswitch 5, please refer to the relevant descriptions of the components with the same names in the keyswitch 1 and the variations thereof, which will not be described in addition. Furthermore, the appearance of the keyswitch 5 is substantially similar to FIG. 1.

In the embodiment, the base 50 includes a base plate 502, an upper cover 504, a sliding engagement structure 506, and a boss 508. The upper cover 504 and the base plate 502 are connected by engaging hooks 5022 with holes 5042 and form an accommodating space 510. The sliding engagement structure 506 is disposed in the accommodating space 510 and is structurally integrated into the upper cover 504 to be formed in one piece. The boss 508 and the base plate 502 are provided in one piece. The boss 508 extends toward the keycap 52 in the accommodating space 510. The upper cover 504 has a plunger sleeve 5044. The plunger sleeve 5044 forms a plunger hole at the center portion. The plunger hole connects the accommodating space 510. The return force mechanism 54 includes a first spring 542, a second spring 544, and a connection spring 546 connecting the first spring 542 and the second spring 544. The keycap 52 includes a cap body 522 and a plunger 524. The plunger 524 includes a sliding engagement structure 5242. The plunger 524 is disposed between the base plate 502 and the upper cover 504 and passes upward through the plunger sleeve 5044 to connect with the cap body 522. The sliding engagement structure 5242 of the plunger 524 and the sliding engagement structure 506 of the base 50 are slidably engaged. The return force mechanism 54 contacts between the plunger 524 and the base plate 502. The switch 58 is fixed on the base plate 502 and includes a fixed contacting part 582 and a movable contacting part 584 disposed neighboring to the fixed contacting part 582. The plunger 524 includes a triggering portion 5244 for selectively pushing against the movable contacting part 584, so that the movable contacting part 584 and the fixed contacting part 582 contact each other or are separate, which leads to conducting or breaking the switch 58. Therein, the movable contacting part 584 has a fixed end 5842, a free end 5844, and a contacting portion 5846. The movable contacting part 584 is fixed on the base plate 502 through the fixed end 5842 opposite to the fixed contacting part 582. The contacting portion 5846 is located between the fixed end 5842 and the free end 5844 and is used for electrically contacting the fixed contacting part 582. The triggering portion 5244 pushes the movable contacting part 584 through the free end 5844.

Figure 19:
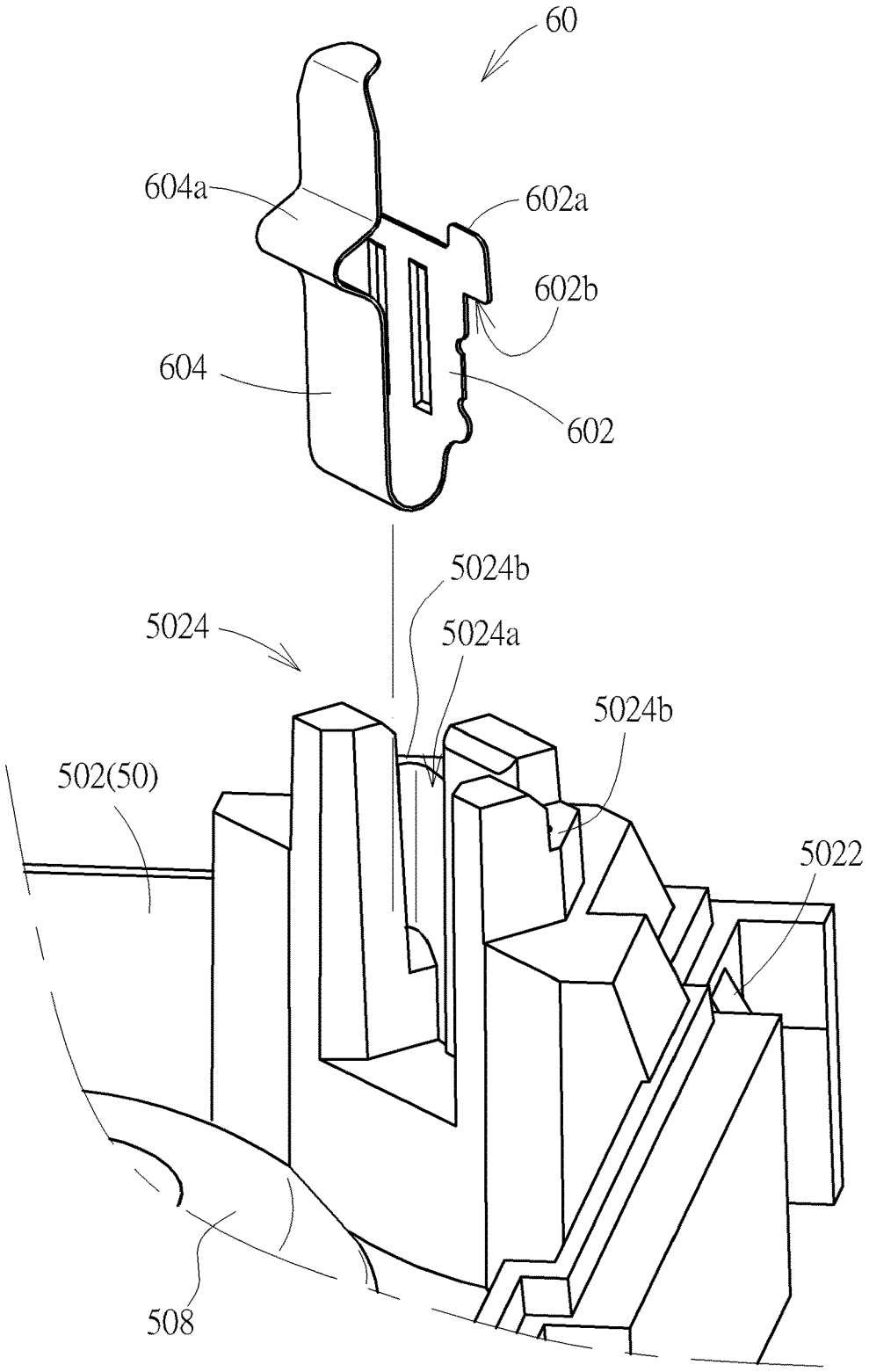
FIG. 19 is a schematic diagram illustrating the assembly of an elastic piece and an elastic piece socket of the keyswitch in FIG. 18.
Figure 20:
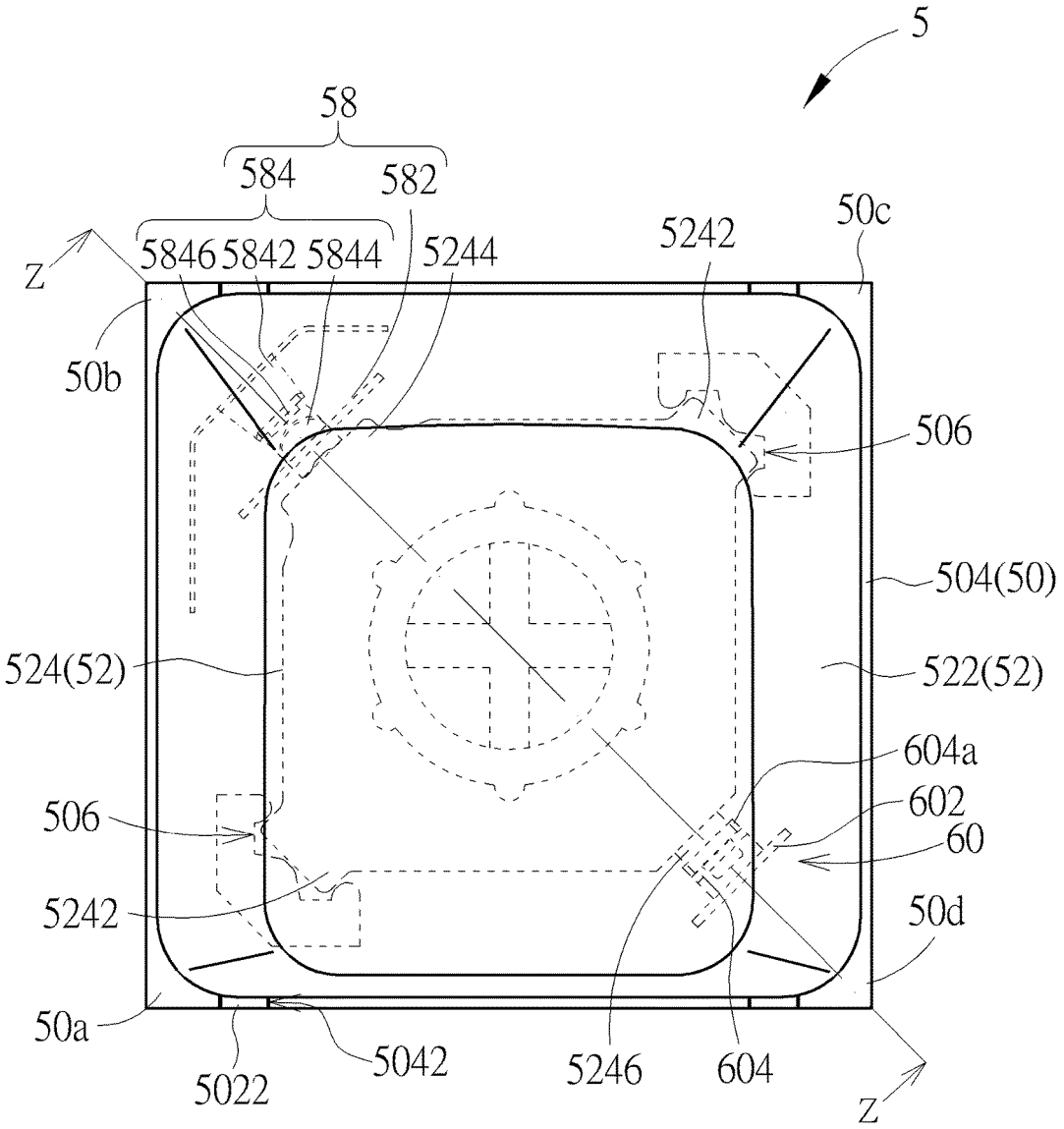
FIG. 20 is a top view of the keyswitch in FIG. 18.

Furthermore, the elastic piece 60 is slidably disposed in an elastic piece socket 5024 disposed on the base plate 502. The elastic piece socket 5024 is located in the accommodating space 510. Therein, the elastic piece 60 includes a sliding portion 602, an elastic portion 604 connected to the sliding portion 602, and a protruding portion 604*a* disposed on the elastic portion 604. The elastic piece socket 5024 has a sliding slot 5024*a* and an upper surface 5024*b*. The upper surface 5024*b* is located at an end side of the sliding slot 5024*a*. The elastic piece 60 is slidably disposed in the elastic piece socket 5024 by the sliding portion 602 sliding in the sliding slot 5024*a* (as shown by FIG. 19). The sliding portion 602 has an upper edge 602*a* and a stop portion 602*b*. The upper edge 602*a* is right opposite to a lower surface 5046 of the upper cover 504. The lower surface 5046 can stop the upper edge 602*a* for preventing the sliding portion 602 from sliding upward further. The stop portion 602*b* is right opposite to the upper surface 5024*b*. The upper surface 5024*b* can stop the stop portion 602*b* for preventing the sliding portion 602 from sliding downward further. The plunger 524 includes an engaging part 5246 for selectively pushing against or strumming the protruding portion 604*a* of the elastic piece 60. When the keycap 52 moves up and down relative to the base 50, the engaging part 5246 pushes against the protruding portion 604*a* so that the elastic portion 604 elastically deforms. In the embodiment, the base 50 has a rectangle projection outline (as shown by FIG. 20). The base 50 has sequentially positioned a first corner 50*a*, a second corner 50*b*, a third corner 50*c*, and a fourth corner 50*d*. The sliding engagement structure 506 of the base 50 is located at the first corner 50*a* and the third corner 50*c*. The switch 58 is located at the second corner 50*b*. The elastic piece 60 is located at the fourth corner 50*d*. The sliding engagement structure 5242 of the plunger 524 corresponds to the first corner 50*a* and the third corner 50*c*. The triggering portion 5244 corresponds to the second corner 50*b*. The engaging part 5246 corresponds to the fourth corner 50*d*. In the embodiment, the elastic piece 60 and the movable contacting part 584 of the switch 58 are oppositely disposed and are provided by two cantilever structures respectively, which is conducive to the balance of forces applied to the plunger 524.

Figure 21:
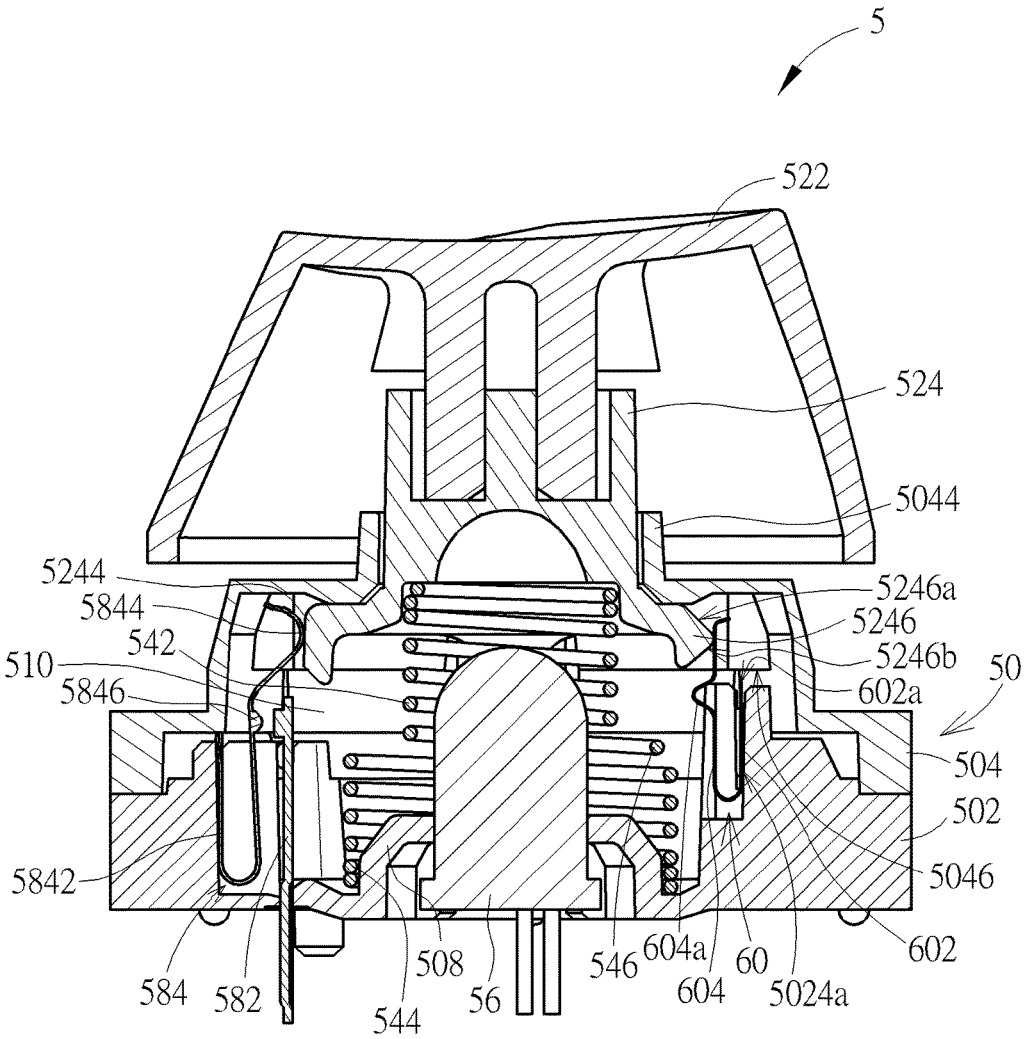
FIG. 21 is a sectional view of the keyswitch in FIG. 18 along the line Z-Z in FIG. 19 when a keycap thereof is located at an initial position.

For more details, as shown by FIG. 21, the keycap 52 is not pressed yet and is located at an initial position. At the moment, the triggering portion 5244 pushes against the movable contacting part 584 through the free end 5844, so that the contacting portion 5846 of the movable contacting part 584 and the fixed contacting part 582 are separate. The engaging part 5246 does not contact the protruding portion 604*a* of the elastic piece 60.

Figure 22:
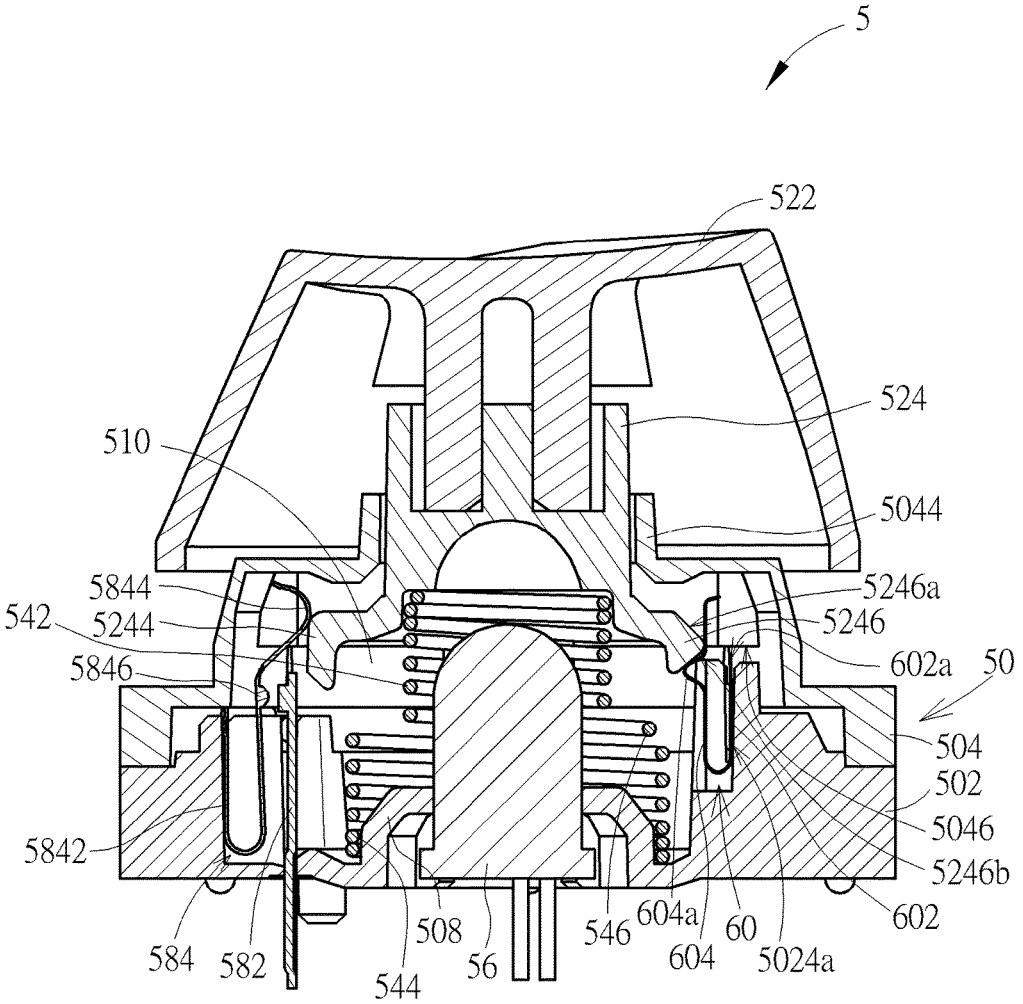
FIG. 22 is a sectional view of the keyswitch in FIG. 21 when the keycap is pressed to be located at a contacting position lower than the initial position.

As shown by FIG. 22, when the keycap 52 is pressed to move downward to a contacting position, the engaging part 5246 contacts the top of the protruding portion 604*a* of the elastic piece 60 through a lower ramp surface 5246*b* of the engaging part 5246. At the moment, the triggering portion 5244 still remains pushing against the movable contacting part 584 through the free end 5844, so that the contacting portion 5846 of the movable contacting part 584 and the fixed contacting part 582 remain separate. Furthermore, when the keycap 52 is pressed to proceed to move downward, the engaging part 5246 applies a force (i.e. an obliquely downward force) to the protruding portion 604*a* of the elastic piece 60 through the lower ramp surface 5246*b*; in other words, the engaging part 5246 obliquely downward pushes against the protruding portion 604*a*. Because the stop portion 602*b* of the sliding portion 602 of the elastic piece 60 abuts against the upper surface 5024*b* of the elastic piece socket 5024, the vertical and downward component of the applied force will not drive the sliding portion 602 to move downward relative to the elastic piece socket 5024. However, the applied force render the elastic portion 604 of the elastic piece 60 elastically deform because the protruding portion 604*a* is pushed by the engaging part 5246.

Figure 23:
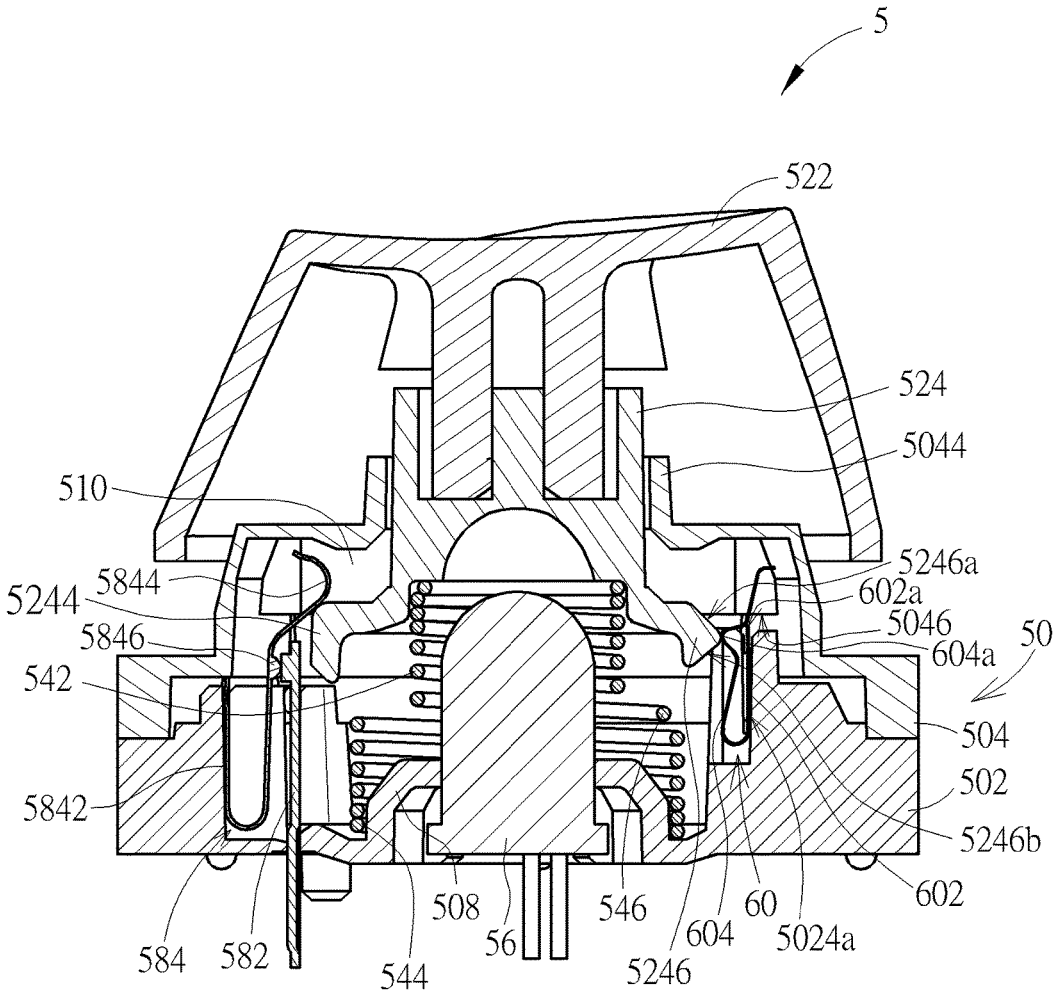
FIG. 23 is a sectional view of the keyswitch in FIG. 21 when the keycap is pressed to be located at a triggering position lower than the contacting position.

As shown by FIG. 23, when the keycap 52 is pressed to proceed to move downward to a triggering position, the contacting portion 5846 begins to contact the fixed contacting part 582; that is, the keycap 52 triggers the switch 58 through the triggering portion 5244. At the moment, the elastic portion 604 of the elastic piece 60 elastically deforms due to the engaging part 5246 pushing the protruding portion 604*a* of the elastic piece 60 through the engaging part 5246, so that the tip of the engaging part 5246 just pushes against the tip of the protruding portion 604*a*. In other words, (1) before the keycap 52 is pressed down to reach the triggering position, the elastic piece 60 contacts and pushes against the lower ramp surface 5246*b* of the engaging part 5246, so that the elastic piece 60 has elastically deformed in a certain degree and applies a force (i.e. an obliquely upward force) to the engaging part 5246 through the lower ramp surface 5246*b*. In principle, the vertical and upward component of the applied force will be transferred to the keycap 52 through the plunger 524 for resisting the downward movement of the keycap 52, so that the user can sense a larger pressing resistance (than that before the engaging part 5246 contacts the protruding portion 604*a*) by his finger. (2) When the keycap 52 is pressed to proceed to move to be lower the triggering position, the engaging part 5246 pushes against the bottom of the protruding portion 604*a* of the elastic piece 60 through the upper ramp surface 5246*a*. At the moment, the elastic portion 604 of the elastic piece 60 is restored gradually but some elastic deformation still remains. Therefore, the elastic piece 60 applies a force (i.e. an obliquely downward force) to the engaging part 5246 through the upper ramp surface 5246*a*. In principle, the vertical and downward component of the applied force will be transferred to the keycap 52 through the plunger 524 for facilitating the downward movement of the keycap 52, so that the user can sense a less pressing resistance by his finger. Therefore, when pressing down the keycap 52, the user can sense a clear variation of the pressing resistance by his finger before and after the keycap 52 reaches the triggering position, which provides the user a tactile feedback for confirmation that the switch 58 has been triggered to be conducted.

Figure 24:
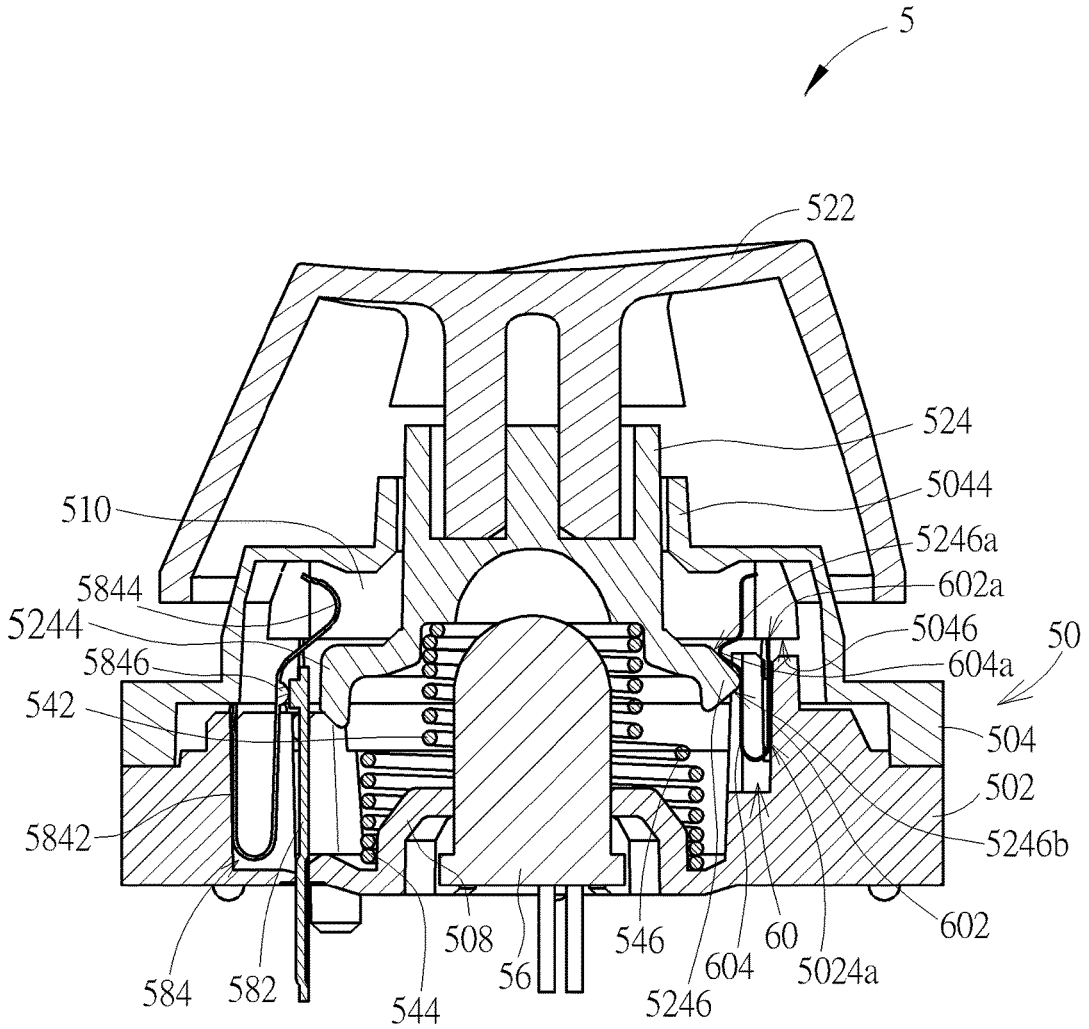
FIG. 24 is a sectional view of the keyswitch in FIG. 21 when the keycap is pressed to be located at a position between the triggering position and a transition position lower than the triggering position.

Furthermore, when the engaging part 5246 contacts the protruding portion 604*a* of the elastic piece 60 through the upper ramp surface 5246*a*, the engaging part 5246 also applies a force (i.e. an obliquely upward force) to the elastic piece 60 through the upper ramp surface 5246*a*. The vertical and upward component of the applied force drives the sliding portion 602 of the elastic piece 60 to slide upward relative to the elastic piece socket 5024. In the embodiment, as shown by FIG. 24, the upper edge 602*a* of the sliding portion 602 is against the lower surface 5046 of the upper cover 504. Even though the engaging part 5246 continues applying the force to the elastic piece 60 through the upper ramp surface 5246*a*, the force cannot drive the sliding portion 602 to slide upward further. In other words, the engaging part 5246 obliquely upward pushes against the protruding portion 604*a*, so that the sliding portion 602 can slide upward along the sliding slot 5024*a*; when the upper edge 602*a* abuts against the lower surface 5046 of the upper cover 504, the sliding portion 602 stops sliding upward. Furthermore, in the embodiment, when the upper edge 602*a* of the sliding portion 602 is against the lower surface 5046 of the upper cover 504, the engaging part 5246 and the protruding portion 604*a* are separate. Therefore, before the engaging part 5246 departs away from the protruding portion 604*a*, it is certain that the sliding portion 602 will contact the upper cover 504. Under a consideration to the interaction between the engaging part 5246 and the elastic piece 60, in principle, the sliding portion 602 is against the lower surface 5046 of the upper cover 504 by the upper edge 602*a* hitting the lower surface 5046 of the upper cover 504, which can produce noise. The noise can be taken as a hearing feedback for the user to confirm that the switch 58 has been triggered to be conducted. In practice, it is applicable to design that when the upper edge 602*a* of the sliding portion 602 abuts against the lower surface 5046 of the upper cover 504, some elastic deformation of the elastic portion 604 remains. At the moment, the engaging part 5246 still applies force to the elastic piece 60 through the protruding portion 604*a*. Thereby, the upper edge 602*a* of the sliding portion 602 will hit the lower surface 5046 of the upper cover 504 in a larger force, which produces louder noise. However, the invention is not limited thereto. For example, if the sliding portion 602 of the elastic piece 60 clearance fits in the sliding slot 5024*a* of the elastic piece socket 5024, the sliding portion 602 can loosely slide in the sliding slot 5024*a*. The applied force to the protruding portion 604*a* through the upper ramp surface 5246*a* by the engaging part 5246 can accelerate the sliding portion 602 so that the sliding portion 602 can obtain enough kinetic energy so as to hit the lower surface 5046 of the upper cover 504 after the engaging part 5246 and the protruding portion 604*a* are separate, which also can produce noise as a hearing feedback.

Figure 25:
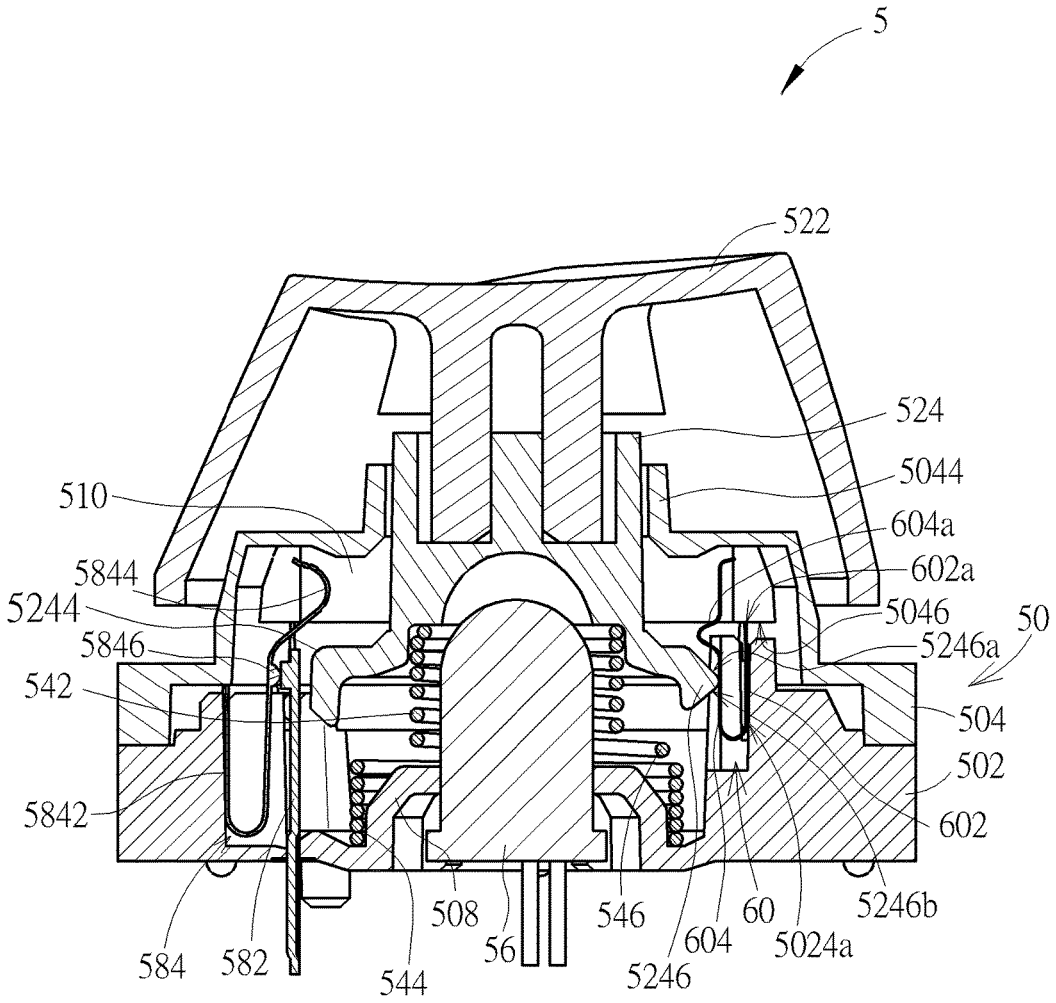
FIG. 25 is a sectional view of the keyswitch in FIG. 21 when the keycap is pressed to be located at the transition position.

Afterward, as shown by FIG. 25, when the keycap 52 is pressed to proceed to move downward to a transition position, the engaging part 5246 has departed from the elastic piece 60 in a distance, and the elastic piece 60 has moved upward to hit the lower surface 5046 of the upper cover 504 to make noise. In other words, after the keycap 52 departs from the triggering position and before the keycap 52 reaches the transition position, the elastic piece 60 springs back to its original structure and hits the upper cover 504 to make noise. By a sound variation due to the occurrence of the noise, the user can receive a hearing feedback for confirmation that the switch 58 has been triggered to be conducted.

Therefore, when the keycap 52 triggers the switch 58 through the triggering portion 5244 (i.e. the keycap 52 passes through the triggering position) once, the user can receive one tactile feedback of resistance variation and one hearing feedback of noise due to the interaction between the engaging part 5246 and the elastic piece 60.

In addition, in the movement of the keycap 52 from the transition position back to the initial position, the engaging part 5246 pushes against the protruding portion 604*a* again and applies an obliquely downward force to the protruding portion 604*a* through the lower ramp surface 5246*b*, so that the sliding portion 602 can slide downward along the sliding slot 5024*a*. When the keycap 52 returns back to the initial position, no matter whether the stop portion 602*b* of the sliding portion 602 is against the upper surface 5024*b* of the elastic piece socket 5024, the engaging part 5246 still can apply an obliquely downward force to the protruding portion 604*a* through the lower ramp surface 5246*b* in a next pressing on the keycap 52, so that the stop portion 602*b* of the sliding portion 602 can abut against the upper surface 5024*b* of the elastic piece socket 5024. The above actions of pressing down the keycap 52 repeat accordingly and will not be repeatedly described herein. In addition, in the embodiment, the ramp surfaces 5246*a* and 5246*b* of the engaging part 5246 and the protruding portion 604*a* (itself provided with a curve surface) can provide a surface for applying the oblique forces thereon, so in practice, it is applicable to choose one for designing the keyswitch. Furthermore, it is added that, in the figures relative to the embodiment, the tip of the engaging part 5246 just touches the surface of the elastic portion 604 (excluding the protruding portion 604*a*), which is regarded as no elastic deformation of the elastic piece 60 (excluding the protruding portion 604*a*) by the tip of the engaging part 5246. In practice, it is applicable to design a gap always existing between the tip of engaging part 5246 and the surface of the elastic portion 604 (excluding the protruding portion 604*a*); however, the invention is not limited thereto. In principle, in the embodiment, the driving force for moving the elastic piece 60 is mainly based on the structure interference produced when the protruding portion 604*a* and the engaging part 5246 move relatively. Therefore, in practice, even if the engaging part 5246 also makes the elastic piece 60 produce a little elastic deformation through the elastic portion 604 (in addition to by the protruding portion 604*a*), the upper edge 602*a* of the sliding portion 602 still can effectively hit the lower surface 5046 of the upper cover 504 to make noise. For an example that takes the configuration shown by FIG. 24 as a reference, when the engaging part 5246 begins to depart from the protruding portion 604*a*, the upper edge 602*a* abuts against (or hits) the lower surface 5046. In this case, whether the engaging part 5246 also pushes against the elastic portion 604 (excluding the protruding portion 604*a*) to elastically deform the elastic piece 60 will not affect the fact that the noise is produced.

In addition, in the embodiment, the elastic piece 60 is a cantilever structure, of which the suspended portion extends substantially in the vertical direction; however, the invention is not limited thereto. For example, the elastic piece can be realized by a metal slip horizontally inserted into the base 50 by an end thereof. In this case, the suspended portion of the metal slip can interact with the engaging part 5246 to produce a variation of tactile feeling and noise.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch, comprising:

a keycap;

a base, disposed under the keycap and comprising a boss extending toward the keycap; and a combination of springs, disposed between the keycap and the base, the combination of springs comprising a first spring and a second spring connected with the first spring in series, so that when the keycap receives a pressing force to move from an initial position toward the base, the keycap transfers the pressing force to the combination of springs, and the pressing force is then transferred to the base through the first spring and the second spring in order, an outer diameter of the boss being less than a coil inner diameter of the second spring, the outer diameter of the boss being larger than a coil inner diameter of the first spring, the second spring being sleeved on the boss and comprising a plurality of elastic coils;

wherein when the keycap moves from the initial position toward the base beyond a transition position, the second spring is fully compressed to be solid such that a height of the compressed spring reaches a corresponding solid height, a lower end of the first spring abuts against the boss, the first spring is not fully compressed and remains elastically deformable as the keycap moves toward the base further, and the plurality of elastic coils substantially stack vertically.

2. The keyswitch of claim 1, further comprising a light source, wherein the boss further has a receiving hole, the receiving hole vertically extends through the boss, a horizontal cross-section of the light source is smaller than the coil inner diameter of the first spring, a vertical height of the light source is higher than the boss, and the light source passes through the receiving hole and extends upward into the combination of springs.

3. The keyswitch of claim 2, wherein the keycap further comprises a bottom receiving space, when the keycap is at the initial position, a top of the first spring is higher than a top of the light source, and when the keycap is located lower than the transition position, the top of the light source is higher than the top of the first spring, and a portion of the light source is located within the bottom receiving space.

4. The keyswitch of claim 1, further comprising a switch, wherein the switch is fixed on the base, the switch comprises a fixed contacting part and a movable contacting part disposed neighboring to the fixed contacting part, the keycap comprises a triggering portion, when the keycap is at the initial position, the triggering portion pushes against the movable contacting part to make the movable contacting part separated from the fixed contacting part, when the keycap moves toward the base beyond a triggering position, the triggering portion and the movable contacting part are separate so that the movable contacting part moves to contact the fixed contacting part, and the triggering position is located between the initial position and the transition position so that after the switch is conducted, the keycap is movable downward further to reach the transition position.

5. The keyswitch of claim 4, wherein a lower end of the second spring is disposed on the base, and an extension portion extends from the lower end of the second spring and forms the fixed contacting part.

6. The keyswitch of claim 1, further comprising a switch and an elastic piece, wherein the switch is fixed on the base, the switch comprises a fixed contacting part and a movable contacting part disposed neighboring to the fixed contacting part, the base comprises two first sliding parts disposed oppositely, the keycap has two second sliding parts, an engaging part, and a triggering portion, the two second sliding parts are positioned on opposite sides of the keycap, the engaging part and the triggering portion are positioned on opposite sides of the keycap, the first sliding parts and the two second sliding parts are slidably engaged with each other, when the keycap is at the initial position, the triggering portion pushes against the movable contacting part to make the movable contacting part separated from the fixed contacting part, the elastic piece comprises an elastic portion and a protruding portion disposed on the elastic portion, and when the keycap moves up and down relative to the base, the engaging part pushes against the protruding portion so that the elastic portion elastically deforms.

7. The keyswitch of claim 6, wherein the elastic piece comprises a sliding portion, the elastic portion is connected to the sliding portion, the base comprises an elastic piece socket, the elastic piece socket has a sliding slot, and the elastic piece is slidably disposed in the elastic piece socket by the sliding portion sliding in the sliding slot.

8. The keyswitch of claim 7, wherein when the keycap moves from the initial position toward the base to a triggering position, the engaging part obliquely downward pushes against the protruding portion to prevent the sliding portion move upward along the sliding slot.

9. The keyswitch of claim 8, wherein when the keycap proceeds to move downward from the triggering position, the engaging part obliquely upward pushes against the protruding portion, so that the sliding portion moves upward along the sliding slot.

10. The keyswitch of claim 9, wherein the sliding portion has an upper edge, the base has an accommodating space and a lower surface corresponding to the upper edge, the protruding portion is higher than the upper edge and received within the accommodating space, and the upper edge is beneath the lower surface, so that the sliding portion moves upward along the sliding slot until the upper edge engaging with the lower surface of the base.

11. A keyswitch, comprising:

a keycap, comprising a triggering portion;

a base, disposed under the keycap;

a combination of springs, disposed between the keycap and the base, the combination of springs comprising a first spring and a second spring connected with the first spring in series, so that when the keycap receives a pressing force to move from an initial position toward the base, the keycap transfers the pressing force to the combination of springs, and the pressing force is then transferred to the base through the first spring and the second spring in order; and a switch, fixed on the base and comprising a fixed contacting part and a movable contacting part disposed neighboring to the fixed contacting part, the movable contacting part being a cantilever structure, the cantilever structure having a fixed end, a free end, and a contacting portion, the cantilever structure being fixed on the base through the fixed end, the contacting portion being located between the fixed end and the free end and being used for electrically contacting the fixed contacting part;

wherein when the keycap moves from the initial position toward the base beyond a transition position, one of the first spring and the second spring is fully compressed to be solid such that a height of the compressed spring reaches a corresponding solid height, and the other one of the first spring and the second spring is not fully compressed and remains elastically deformable as the keycap moves toward the base further, the compressed spring whose height reaches the corresponding solid height comprises a plurality of elastic coils, and the plurality of elastic coils substantially stack vertically;

wherein when the keycap is at the initial position, the triggering portion pushes against the movable contacting part through the free end to make the movable contacting part separated from the fixed contacting part, and when the keycap moves toward the base beyond a triggering position, the triggering portion and the movable contacting part are separate so that the movable contacting part moves to contact the fixed contacting part through the contacting portion.

12. The keyswitch of claim 11, further comprising a light source, wherein the base comprises a boss, the boss extends toward the keycap, an outer diameter of the boss is less than a coil inner diameter of the second spring, the outer diameter of the boss is larger than a coil inner diameter of the first spring, the second spring is sleeved on the boss, when the keycap moves toward the base beyond the transition position, the second spring is compressed to be solid such that a height of the second spring reaches a corresponding solid height, and a lower end of the first spring abuts against the boss, the boss further has a receiving hole, the receiving hole vertically extends through the boss, a horizontal cross-section of the light source is smaller than the coil inner diameter of the first spring, a vertical height of the light source is higher than the boss and the light source passes through the receiving hole and extends upward into the combination of springs.

13. The keyswitch of claim 12, wherein the keycap further comprises a bottom receiving space, when the keycap is at the initial position, a top of the first spring is higher than a top of the light source, and when the keycap is located lower than the transition position, the top of the light source is higher than the top of the first spring, and a portion of the light source is located within the bottom receiving space.

14. The keyswitch of claim 11, wherein the triggering position is located between the initial position and the transition position so that after the switch is conducted, the keycap is movable downward further to reach the transition position.

15. The keyswitch of claim 14, wherein a lower end of the second spring is disposed on the base, and an extension portion extends from the lower end of the second spring and forms the fixed contacting part.

16. The keyswitch of claim 11, further comprising an elastic piece, wherein the base comprises two first sliding parts disposed oppositely, the keycap comprises an engaging part and two second sliding parts, the two second sliding parts are positioned on opposite sides of the keycap, the engaging part and the triggering portion are positioned on the opposite side of the keycap, the first sliding parts and the two second sliding parts are slidably engaged with each other, so that a movement of the keycap between the initial position and the transition position is a linear movement, the elastic piece comprises an elastic portion and a protruding portion disposed on the elastic portion, and when the keycap moves up and down relative to the base, the engaging part pushes against the protruding portion so that the elastic portion elastically deforms.

17. The keyswitch of claim 16, wherein the elastic piece comprises a sliding portion, the elastic portion is connected to the sliding portion, the base comprises an elastic piece socket, the elastic piece socket has a sliding slot, and the elastic piece is slidably disposed in the elastic piece socket by the sliding portion sliding in the sliding slot.

18. The keyswitch of claim 17, wherein when the keycap moves from the initial position toward the base to the triggering position, the engaging part obliquely downward pushes against the protruding portion to prevent the sliding portion move upward along the sliding slot.

19. The keyswitch of claim 18, wherein when the keycap proceeds to move downward from the triggering position, the engaging part obliquely upward pushes against the protruding portion, so that the sliding portion moves upward along the sliding slot.

20. The keyswitch of claim 19, wherein the sliding portion has an upper edge, the base has an accommodating space and a lower surface corresponding to the upper edge, the protruding portion is higher than the upper edge and received within the accommodating space, the upper edge is beneath the lower surface, so that the sliding portion moves upward along the sliding slot until the upper edge engaging with the lower surface of the base.

21. A keyswitch, comprising:

a base, the base comprising an accommodating space, a lower surface, a first sliding part, and an elastic piece socket, the elastic piece socket comprising a sliding slot;

a keycap, the keycap comprising an engaging part and a second sliding part, the first sliding part and the second sliding part being slidably engaged with each other, so that a movement of the keycap between an initial position and a transition position is a linear movement;

a spring, disposed between the keycap and the base, so that when the keycap receives a pressing force to move from the initial position toward the base, the keycap transfers the pressing force to the spring; and an elastic piece, the elastic piece comprising a sliding portion, a protruding portion, and an elastic portion, the elastic portion being formed between the protruding portion and the sliding portion, the sliding portion having an upper edge;

wherein the protruding portion is higher than the upper edge, the protruding portion is located within the accommodating space, and the lower surface is right above the upper edge; wherein the elastic piece is slidably disposed in the elastic piece socket by the sliding portion sliding in the sliding slot; wherein when the keycap moves downward toward the base, the engaging part obliquely upward pushes against the protruding portion to make the protruding portion move freely within the accommodating space, so that the sliding portion moves upward until the upper edge engaging with the lower surface of the base.

* * * * *